US005530470A

United States Patent [19]

Yoshida et al.

[11] Patent Number: 5,530,470

[45] Date of Patent: Jun. 25, 1996

[54] RECORDING APPARATUS WITH CONTROLLED THERMAL TRANSFER ENERGY

[75] Inventors: Takehiro Yoshida, Tokyo; Makoto Kobayashi, Tama; Minoru Yokoyama, Yokohama; Takeshi Ono, Kawasaki; Takashi Awai; Yasushi Ishida, both of Tokyo; Akihiro Tomoda, Yokohama; Mamoru Osada, Yokohama; Takahiro Kato, Yokohama; Tomoyuki Takeda, Yokohama; Masaya Kondo, Tokyo; Masakatsu Yamada; Yukio Nohata, both of Yokohama, all of Japan

[73] Assignee: Canon Kabushiki Kaisha, Tokyo, Japan

[21] Appl. No.: 55,349

[22] Filed: May 3, 1993

Related U.S. Application Data

[62] Division of Ser. No. 775,122, Oct. 11, 1991.

[30] Foreign Application Priority Data

| | | | |
|---|---|---|---|
| Oct. 17, 1990 | [JP] | Japan | 2-276523 |
| Oct. 17, 1990 | [JP] | Japan | 2-276524 |
| Dec. 26, 1990 | [JP] | Japan | 2-406813 |

[51] Int. Cl.[6] ..... B41J 2/36

[52] U.S. Cl. ..... 347/190; 358/296

[58] Field of Search ..... 358/296; 346/76 PH; 400/223, 226.1, 226.2, 225, 232, 120, 120.09, 120.1; 347/188, 190

[56] References Cited

U.S. PATENT DOCUMENTS

| | | | |
|---|---|---|---|
| 4,712,115 | 12/1987 | Tatsumi et al. | 346/76 PH |
| 4,814,789 | 3/1989 | Ono | 346/76 PH |
| 4,875,056 | 10/1989 | Ono | 346/76 PH |
| 4,967,205 | 10/1990 | Sakaguchi et al. | 346/76 PH |
| 5,122,882 | 6/1992 | Ishida et al. | 358/296 |
| 5,144,329 | 9/1992 | Takeda et al. | 346/1.1 |
| 5,177,499 | 1/1993 | Yoshida et al. | 346/76 PH |
| 5,179,390 | 1/1993 | Yokoyama et al. | 346/76 PH |
| 5,184,151 | 2/1993 | Ono et al. | 346/76 PH |
| 5,187,494 | 2/1993 | Ono et al. | 346/76 PH |
| 5,193,007 | 3/1993 | Yokoyama et al. | 358/296 |
| 5,204,692 | 4/1993 | Awai et al. | 346/76 PH |
| 5,206,661 | 4/1993 | Terajima et al. | 346/76 PH |
| 5,293,530 | 3/1994 | Yoshida et al. | 346/76 PH |

FOREIGN PATENT DOCUMENTS

| | | | |
|---|---|---|---|
| 0156360 | 10/1985 | European Pat. Off. | 400/120 |
| 0086782 | 7/1981 | Japan | 346/76 PH |
| 57-83471 | 5/1982 | Japan . | |
| 62-58917 | 1/1983 | Japan . | |
| 58-201686 | 11/1983 | Japan . | |
| 0076363 | 4/1985 | Japan | 400/120 |

*Primary Examiner*—Huan H. Tran

*Attorney, Agent, or Firm*—Fitzpatrick, Cella, Harper & Scinto

[57] ABSTRACT

A thermal transfer recording apparatus for performing the recording an image on a recording medium by transferring ink contained in an ink sheet to the recording medium has ink sheet a conveyance unit for conveying the ink sheet, a recording medium conveyance unit for conveying the recording medium, a recording unit for recording an image on the recording medium by activating the ink sheet, a counting unit for counting the black dot numbers in the current line, a timing unit for measuring the elapsed time since the image recording in the last line by the recording unit, and a control unit for controlling the ink sheet to be conveyed for a predetermined length without conveying the recording medium in accordance with the timing value of the timing unit and the counting value of the counting unit subsequent to the current line recording by the recording, thus making it possible to separate the ink sheet and recording sheet more reliably to maintain a high recording quality.

12 Claims, 22 Drawing Sheets

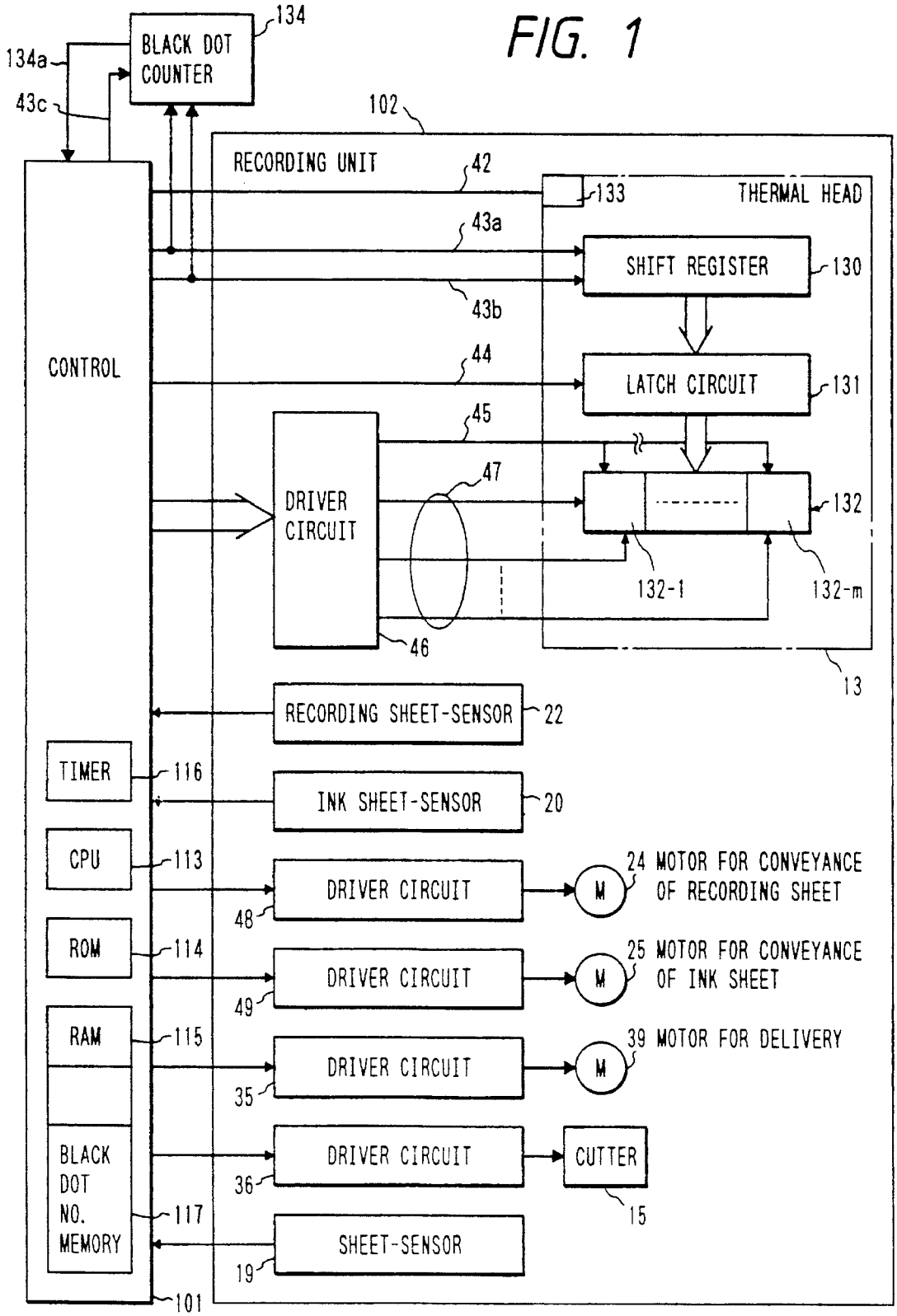
FIG. 1
BLACK DOT COUNTER
134
134a
43c
102
RECORDING UNIT
42
133
THERMAL HEAD
43a
SHIFT REGISTER
130
43b
CONTROL
44
LATCH CIRCUIT
131
45
47
DRIVER CIRCUIT
132
132-1
132-m
46
13
RECORDING SHEET-SENSOR
22
TIMER
116
INK SHEET-SENSOR
20
CPU
113
DRIVER CIRCUIT
24 MOTOR FOR CONVEYANCE OF RECORDING SHEET
M
48
ROM
114
DRIVER CIRCUIT
25 MOTOR FOR CONVEYANCE OF INK SHEET
M
49
RAM
115
DRIVER CIRCUIT
39 MOTOR FOR DELIVERY
M
35
BLACK DOT NO. MEMORY
117
DRIVER CIRCUIT
CUTTER
36
15
SHEET-SENSOR
19
101

| |
|---|
| FIG. 5A-1 |
| FIG. 5A-2 |

FIG. 5C

| RECORDING PERIOD (ms) | BLACK RATE AT B4 | NO. OF DOTS |
|---|---|---|
| 0 ≦ t ≦ 30 | NO | NO |
| 30 < t ≦ 40 | ABOVE 90% | ABOVE 1843 |
| 40 < t ≦ 60 | ABOVE 65% | ABOVE 1331 |
| 60 < t ≦ 250 | ABOVE 75% | ABOVE 1536 |
| 250 < t ≦ 500 | ABOVE 50% | ABOVE 1024 |
| 500 < t | ABOVE 25% | ABOVE 512 |

FIG. 8C

VALUE OF CURRENT RECORDED LINE INFORMATION (ie VALUE OF BLKCOUNT)

| RECORDING PERIOD (ms) | BLACK RATE AT B4 | NO. OF DOTS |
|---|---|---|
| 0 ≦ t ≦ 30 | NO | NO |
| 30 < t ≦ 40 | ABOVE 90% | ABOVE 1843 |
| 40 < t ≦ 60 | ABOVE 65% | ABOVE 1331 |
| 60 < t ≦ 250 | ABOVE 75% | ABOVE 1536 |
| 250 < t ≦ 500 | ABOVE 50% | ABOVE 1024 |
| 500 < t | ABOVE 25% | ABOVE 512 |

OR IN CASE THAT CONDITION:
(MEMORY 117) - (MEMORY 118) ≧ 512 IS SATISFIED

| |
|---|
| FIG. 8A-1 |
| FIG. 8A-2 |

BLACK DOT COUNTER
134
134a
43c
102
RECORDING UNIT
42
133
THERMAL HEAD
43a
SHIFT REGISTER
130
43b
CONTROL
44
LATCH CIRCUIT
131
45
DRIVER CIRCUIT
47
132
132-1
132-m
46
13
RECORDING SHEET-SENSOR
22
INK SHEET-SENSOR
20
TIMER
116
DRIVER CIRCUIT
M
24 MOTOR FOR CONVEYANCE OF RECORDING SHEET
48
CPU
113
DRIVER CIRCUIT
M
25 MOTOR FOR CONVEYANCE OF INK SHEET
49
ROM
114
DRIVER CIRCUIT
M
39 MOTOR FOR DELIVERY
35
RAM
115
DRIVER CIRCUIT
CUTTER
PWDF
36
15
F1
SHEET-SENSOR
19
101

RECORDING APPARATUS WITH CONTROLLED THERMAL TRANSFER ENERGY

This application is a division of application Ser. No. 07/775,122 filed Oct. 11, 1991.

BACKGROUND OF THE INVENTION

1. Field of the Invention

The present invention relates to a thermal transfer recording apparatus for recording image on a recording medium by transferring ink contained in an ink sheet to the recording medium, and a facsimile apparatus using the aforesaid apparatus.

2. Related Background Art

In general, a thermal transfer printer uses an ink sheet with a thermally fusible (or thermally sublimate) ink coated on the base film thereof, and selectively heats such ink sheet by the thermal head in response to image signals in order to transfer the fused (or sublimated) ink to a recording sheet for image recording. Usually, an ink sheet of the kind is such that the contained ink is completely transferred to the recording sheet for one image recording (the so-called one-time sheet). Therefore, it is necessary to convey the ink sheet for an amount equivalent to the length of recorded one character or one line of image after the image recording has been completed, so that the unused portion of the ink sheet should reliably be brought forward to the position for the next recording. Thus the consumption of the ink sheet becomes great and the running cost of the thermal transfer printer tends to be higher than that of a usual thermal printer using thermal sheets for recording.

With a view to solving a problem such as this, there has been proposed a thermal transfer printer in which a recording sheet and an ink sheet are conveyed with a difference in the conveying speeds thereof such as disclosed in Japanese Patent Laid-Open Patent Application No. 57-83471, Japanese Patent Laid-Open Application No. 58-201686 or Japanese Patent Publication No. 62-58917.

The present invention is designed to make a further development of those patents disclosed in the aforesaid applications or publication.

As the ink sheet to be used for these thermal transfer printers, there is known an ink sheet (multiprint sheet) capable of recording images for plural times (n). Then, when a length L of recording is continuously performed using this ink sheet, it is possible to carry on such a recording by making the length of the ink sheet conveyed after each image recording has been completed or during the image being recorded shorter than the length L by (L/n: n>1). Hence, the ink sheet usability efficiency becomes more than the conventional case by n times, and a reduction of the running cost of the thermal transfer printer can be expected. Hereinafter, this recording method is referred to as multiprint.

In the case of a multiprint such as this, the ink layer of the ink sheet is heated by n times separately. Then, at each time of heating, the ink transfer to the recording sheet is performed by generating a shearing force between the fused ink on the ink layer and the ink yet to be fused thereon. As a result, if, for example, the temperature of ink is lowered due to a longer period of time having elapsed before the recording of the next line subsequent to the recording of one line, the force required to shear between the fused ink and the ink yet to be fused (sublimated) becomes greater, leading to a problem that the ink sheet and recording sheet are not easily separable. This condition is particularly conspicuous when a one line recording data contains more black information, and in a facsimile apparatus or the like in which a time interval between a current line and the next line is not constant and such time interval tends to be comparatively long, this condition presents a problem.

In other words, when black information is contained in a considerable amount, the force required to shear between ink layers becomes great if the recording cycle is long because the ink which has once been fused is cooled and this phenomenon appears as an adhesion of the ink sheet to the recording sheet. Therefore, there is a possibility that if a predetermined number of lines should be recorded subsequent to having recorded a line information containing higher black dot numbers, an adhesion such as this occurs depending on its recording cycle and black data rate in one line. If such adhesive force is increased, an elongation of the ink sheet, deflection of the rubber of the platen roller, and the like are generated, making the velocities of the ink sheet and recording sheet essentially equal. Hence, the relative velocities thereof are brought into a level close to substantially zero and there is a possibility that the recording quality is lowered due to the multiprint thus applied.

SUMMARY OF THE INVENTION

The present invention is designed in consideration of the above-mentioned problems, and the object thereof is to provide an improved thermal transfer recording apparatus, and a facsimile apparatus using the aforesaid apparatus.

Another object of the present invention is to provide a thermal transfer recording apparatus capable of preventing any degradation of the recording quality at the time of the multiprint performance and, a facsimile apparatus using the aforesaid apparatus.

Still another object of the present invention is to provide a thermal recording apparatus making it possible to separate with ease the ink sheet and recording sheet subsequent to the image recording, and a facsimile apparatus using the aforesaid apparatus.

A further object of the present invention is to provide a thermal transfer recording apparatus capable of preventing the adhesion of the ink sheet by controlling the ink sheet conveyance or the energy supply to the recording head on the basis of the black dot numbers included in a recording information and recording interval, and a facsimile apparatus using the aforesaid apparatus.

Still a further object of the present invention is to provide a thermal transfer recording apparatus performing its operation in such a manner that the black dot numbers thereby to have recorded an image on a recording medium by energizing the ink sheet are counted and at the same time, the elapsed time after the recording of the last line is measured, and that in response to such measurement of the elapsed time and the counting value obtained by the counting means, the ink sheet is conveyed for a predetermined length without conveying the recording sheet subsequent to the image having been recorded, and a facsimile apparatus using the aforesaid apparatus.

Still a further object of the present invention is to provide a thermal transfer recording apparatus performing its operation in such a manner that the recorded black dot numbers are counted and at the same time, the elapsed time after the recording of the last line is measured, and on the basis of the elapsed time measured by the timer means and the counting value obtained by the counting means or of the difference between the black dot numbers recorded in the last line and the current line, the ink sheet is conveyed for a predetermined length without conveying the recording sheet subsequent to the image having been recorded, and a facsimile apparatus using the aforesaid apparatus.

Still a further object of the present invention is to provide a thermal transfer recording apparatus making it possible to control the energy supply to the recording head in response to the black dot numbers contained in a recording information and the recording mode, and a facsimile apparatus using the aforesaid apparatus.

The above-mentioned and other objects, features and advantages of the present invention will become clear by reference to the following detailed description of the invention taken in conjunction with the accompanying drawings.

BRIEF DESCRIPTION OF THE DRAWINGS

FIG. 5A-1, FIG. 5A-2 and FIG. 5B are flowcharts showing the recording processing in the facsimile apparatus according to the first embodiment;

FIG. 5C is a view illustrating conditions to determine whether or not any excessive conveyance of the ink sheet should be performed after the completion of a one line recording in the facsimile apparatus according to the first embodiment;

FIG. 8A-1, FIG. 8A-2 and FIG. 8B are flowcharts showing the recording processing in the facsimile apparatus according to the second embodiment;

FIG. 8C is a view illustrating conditions to determine whether or not any excessive conveyance of the ink sheet should be performed after the completion of a one line recording in the facsimile apparatus according to the second embodiment;

DETAILED DESCRIPTION OF THE PREFERRED EMBODIMENTS

Hereinafter, the embodiments suited for the present invention will be described in detail in reference to the accompanying drawings.

<The Description of A Facsimile Apparatus (FIG. 1 through FIG. 4)>

Figure 2:
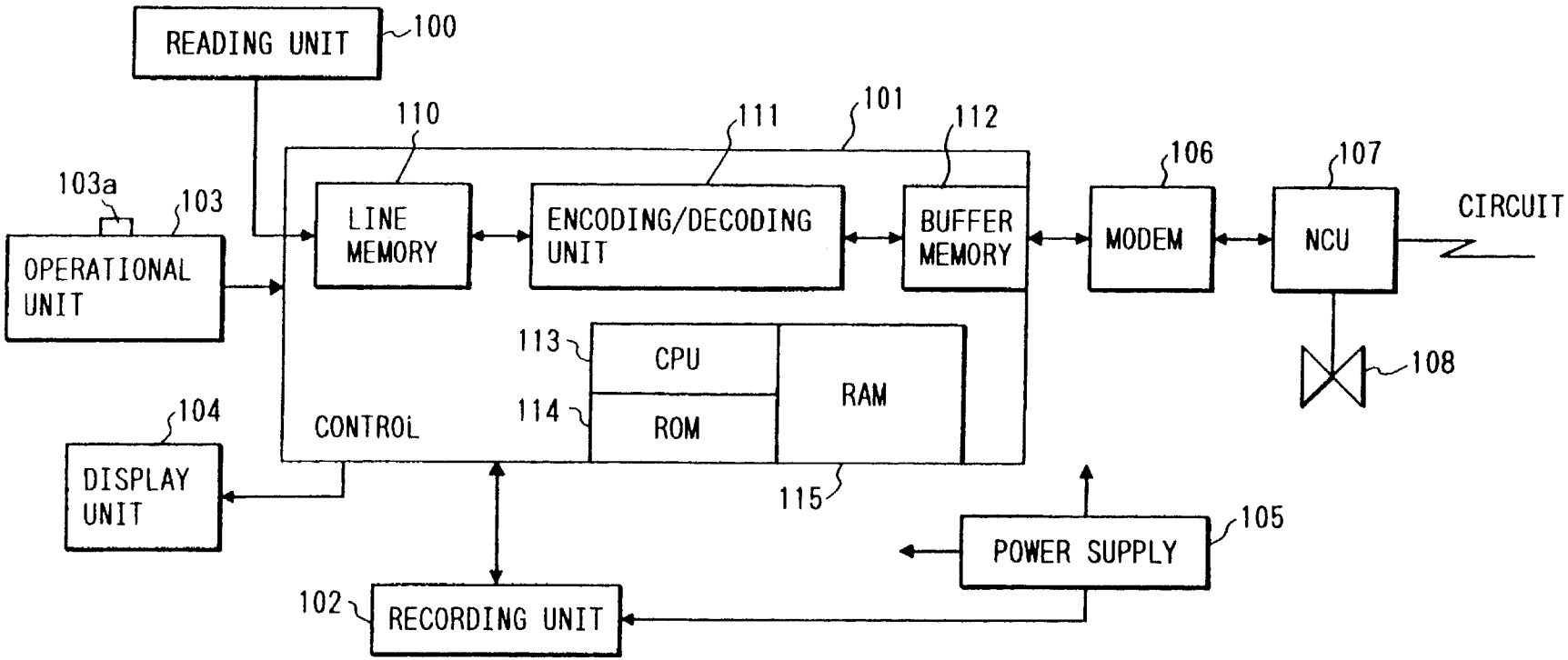
FIG. 2 is a block diagram showing the schematic structure of a facsimile apparatus according to the present embodiment.
Figure 3:
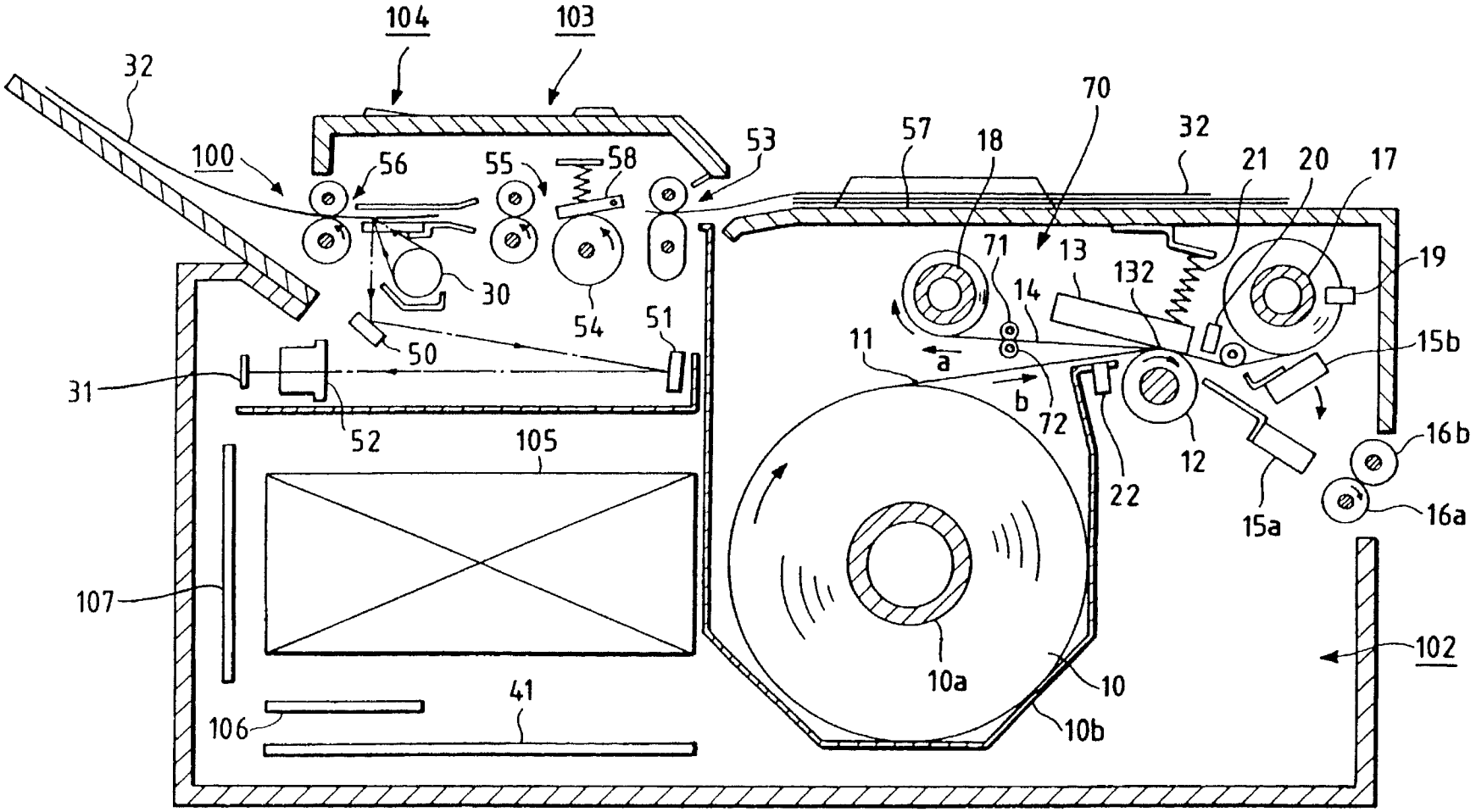
FIG. 3 is a cross-sectional side view showing the mechanical section of a facsimile apparatus according to the present embodiment.
Figure 4:
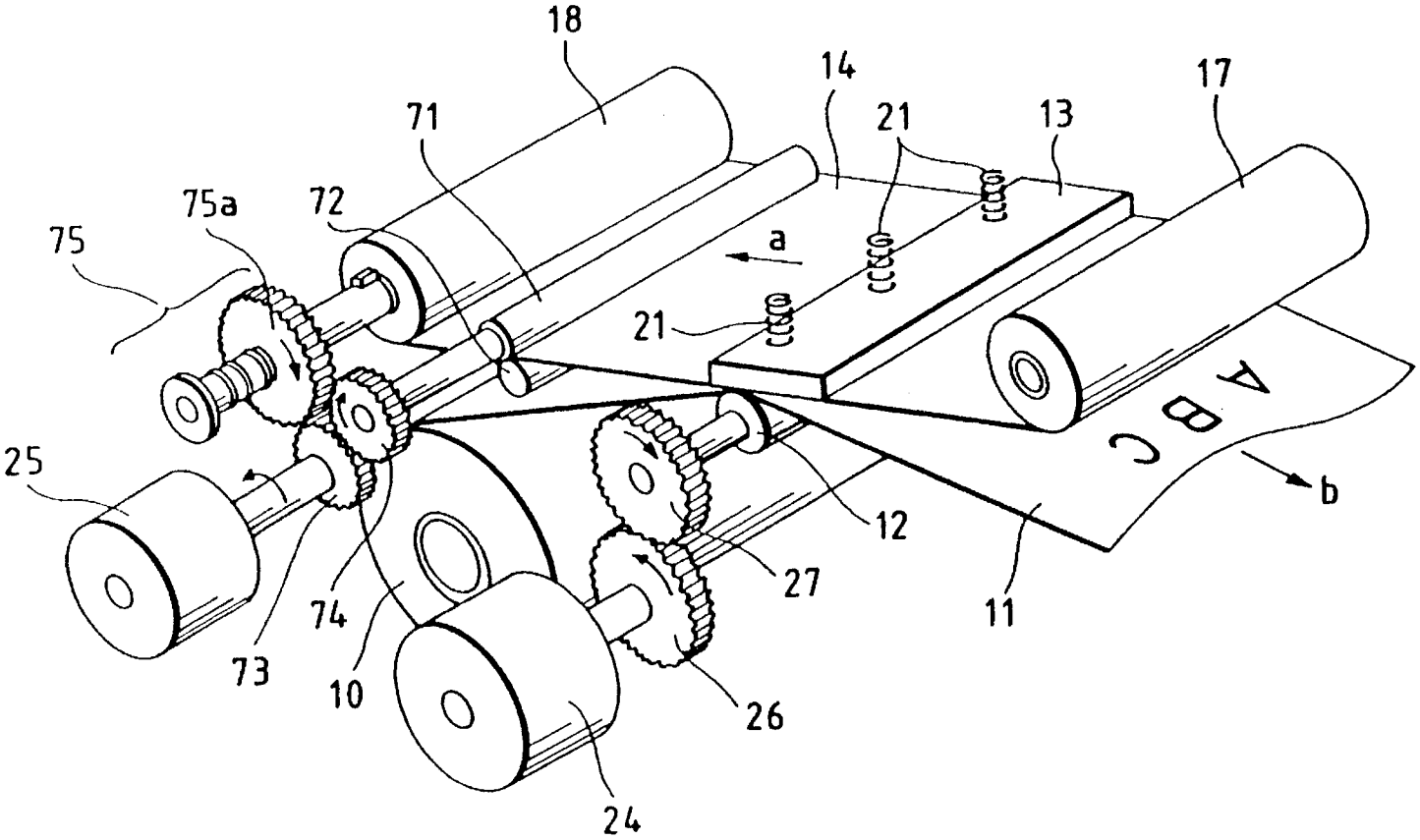
FIG. 4 is a perspective view showing the mechanism to convey the recording sheet and ink sheet according to the present embodiment.
Figures 1, 5A:
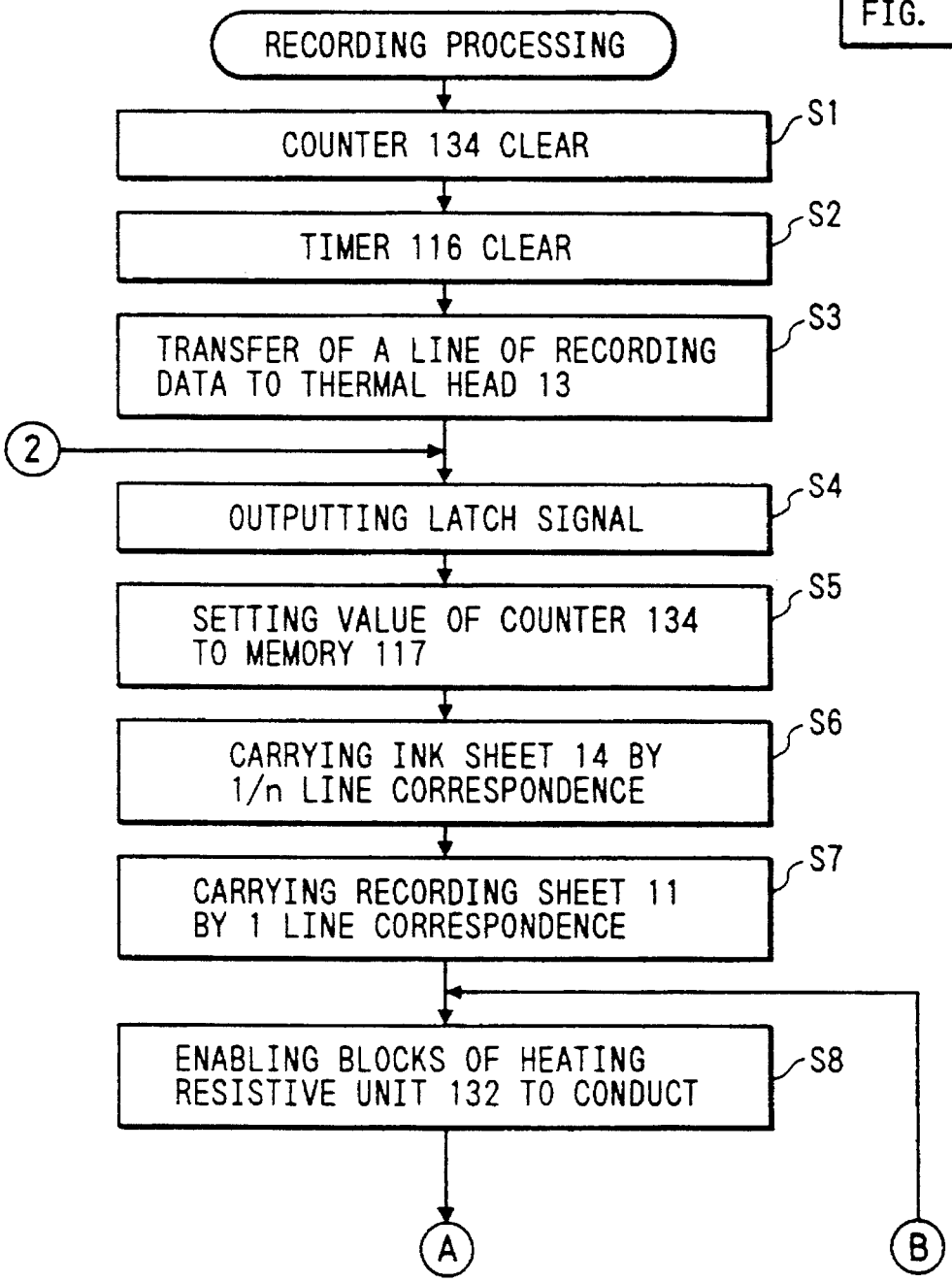
FIG. 1 is a block diagram showing the electrical connection of the control unit and recording unit of a facsimile apparatus according to a first embodiment of the present invention.
FIG. 5A is a block diagram showing that FIG. 5A-1 and FIG. 5A-2 are to be read as connected flowcharts.
Figures 2, 5A:
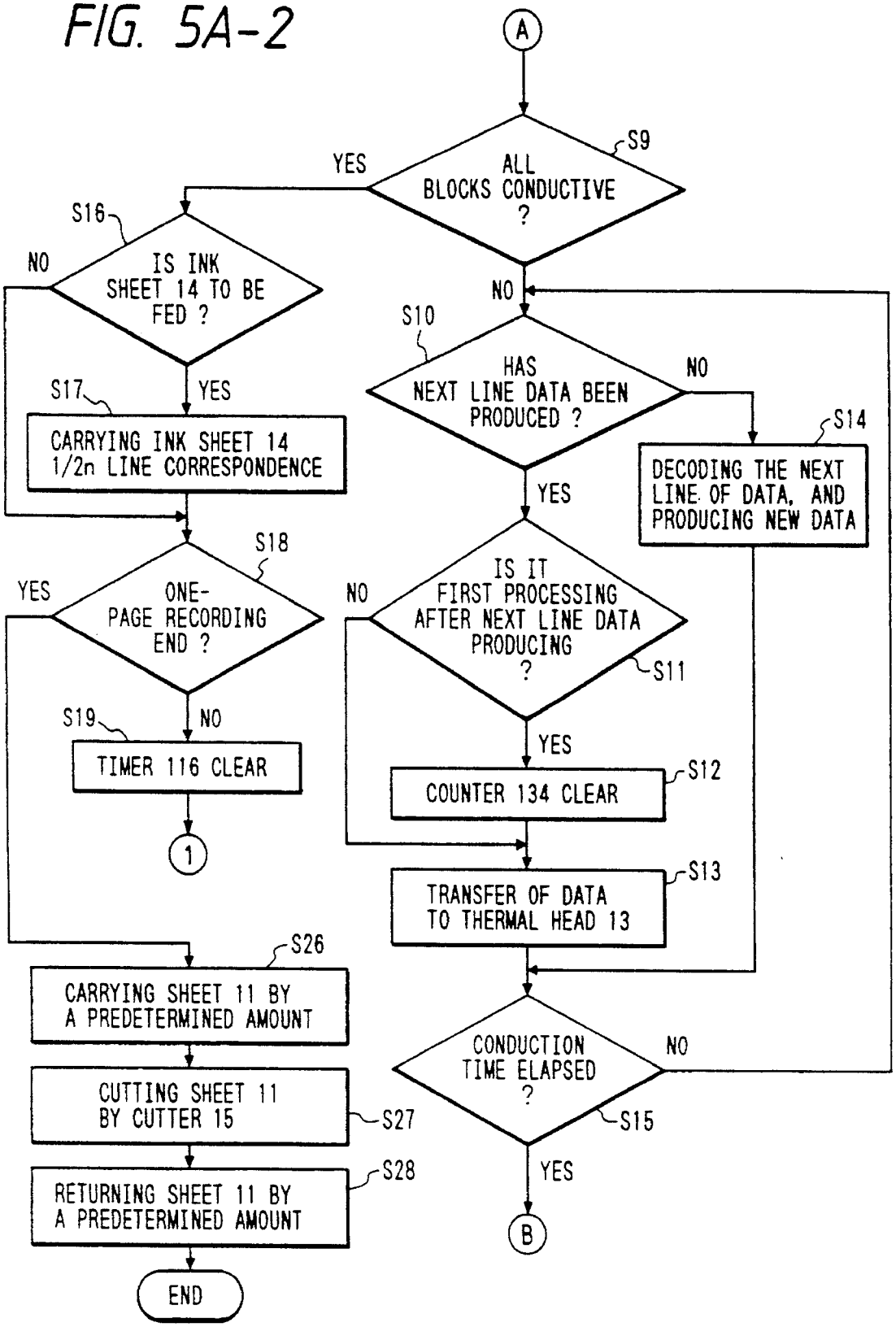
Figure 5B:
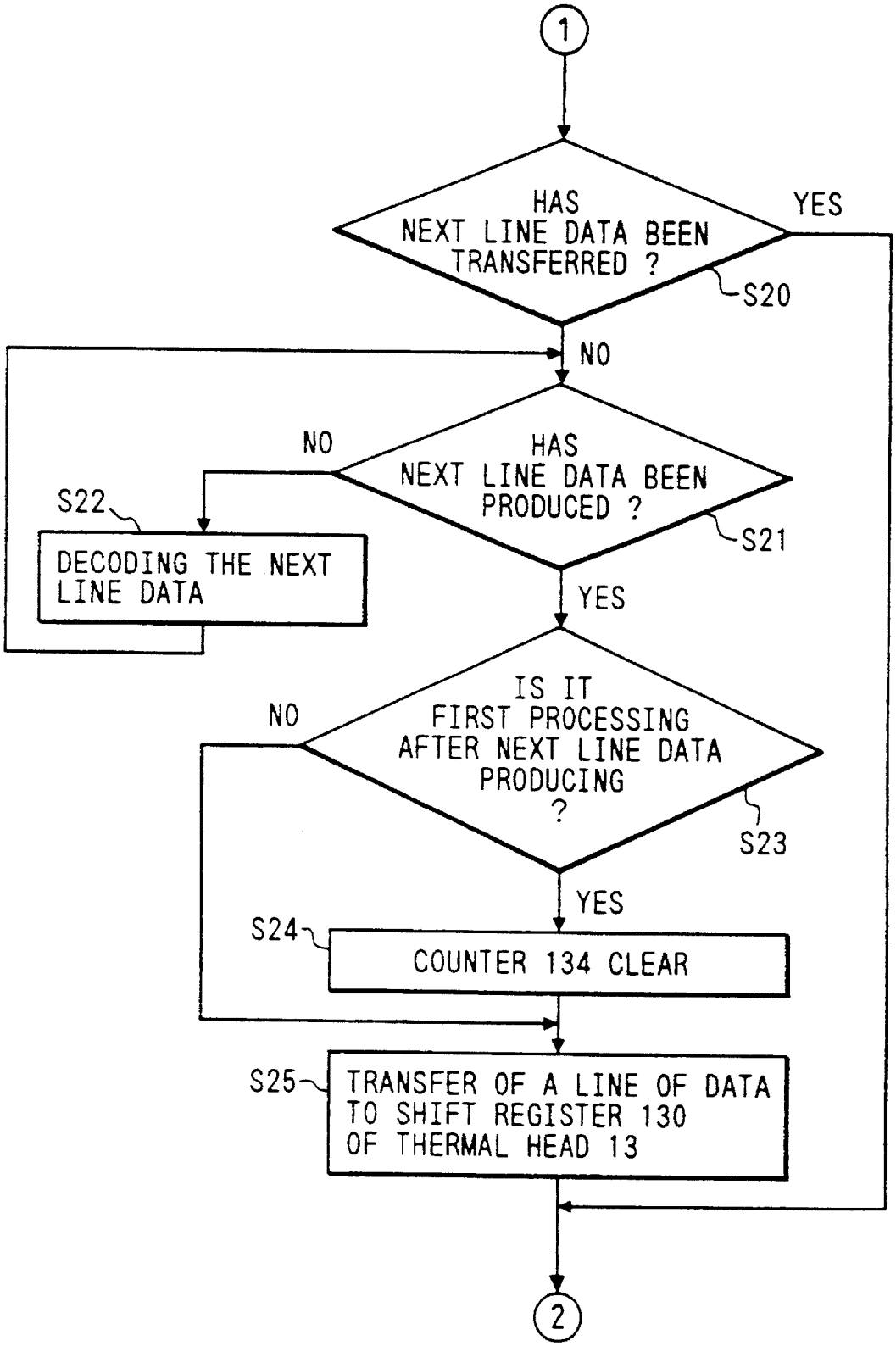

FIG. 1–FIG. 4 are views showing an example of a facsimile apparatus to which a thermal transfer printer using an embodiment of the present invention is applied. FIG. 1 illustrates the electrical connection between the control unit 101 and recording unit 102 of the facsimile apparatus. FIG. 2 is a block diagram showing schematically the structure of the facsimile apparatus. FIG. 3 is a cross-sectional side view of the facsimile apparatus, and FIG. 4 is a view showing the mechanism for conveying the recording sheet and ink sheet.

At first, the schematic structure of a facsimile apparatus according to the present embodiment will be described in conjunction with FIG. 2.

In FIG. 2, a reference numeral 100 designates a reading unit comprising a motor for conveying an original, CCD image sensor, and others to read the original photoelectrically and output it into the control unit 101 as digital image signals. Next, the structure of this control unit 101 is described. A reference numeral 110 designates a line memory to store image data from each line of an image data. When the original is transmitted or copied, the image data of one-line portion from the reading unit 100 is stored, and when receiving an image data, a one-line portion of the decoded image data is stored. Then, an image recording is performed by outputting the stored data into the recording unit 102. A reference numeral 111 designates an encoding/decoding unit to encode an image information to be transmitted by an MH encoding, or the like and at the same time, to decode an encoded image data received and convert it into the image data. Also, a reference numeral 112 designates a buffer memory to store the encoded image data to be transmitted or received. Each of these sections in the control unit 101 is controlled by a CPU 113 comprising a microprocessor and others, for example. In the control unit 101, there are provided, in addition to this CPU 113, a ROM 114 for storing the control program for the CPU 113 and various kinds of data and a RAM 115 temporarily storing various kinds of data as the work area for the CPU 113, and others.

A reference numeral 102 designates a recording unit comprising a thermal line head to perform the recording on a recording sheet using a thermal transfer method. This structure will be described later in detail in reference to FIG. 3.

A reference numeral 103 designates an operational unit including instruction keys for the transmission start and other functions, keys for inputting telephone numbers, and others; 103*a*, a switch for instructing the kind of ink sheet to be used, indicating that a multiprint ink sheet is in use when the switch 103*a* is on and that an ordinary ink sheet is in use when the switch is off; 104, a display unit usually installed adjacent to the operational unit 103 to display each state of the functions, systems, and others; 105, a power supply unit to supply electric power to the entire system; 106, a MODEM (modulator/demodulator); 107, a network control unit (NCU) for performing an automatic receiving by detecting a ringing tone as well as line controls; and 108, a telephone set.

Next, in reference to FIG. 3, the structure of recording unit 102 is described. In this respect, the unit which is common in each of the figures will be designated by the same number.

In FIG. 3, a reference numeral 10 designates a rolled sheet which is an ordinary recording sheet 11 wound around a core 10*a*. This rolled sheet 10 is rotatively accommodated in the apparatus so that the recording sheet 11 can be supplied to the thermal head unit 13 by the rotation of a platen roller 12 in the direction indicated by an arrow. In this respect, a reference numeral 10*b* designates a rolled sheet housing in which the rolled sheet 10 can be set detachably. Also, a reference numeral 12 designates a platen roller for conveying the recording sheet 11 in the direction indicated by an arrow b and pressing the ink sheet 14 and recording sheet 11 between the platen roller and the heat resistive unit 132 of thermal head 13 simultaneously. The recording sheet 11 is conveyed by the further rotation of platen roller 12 in the direction towards exhausting rollers 16 (16*a* and 16*b*) after the image recording has been completed by the heat generation of the thermal head 13, and is cut into the unit of one page by the engagement of cutters 15 (15*a* and 15*b*) when the image recording for the one-page portion is completed.

A reference numeral 17 designates an ink sheet supply roller with ink sheet 14 wound around thereon; 18, an ink sheet winding roller driven by a motor for conveying ink sheet, which will be described later, to take up the ink sheet 14 in the direction indicated by an arrow a. In this respect, these ink sheet supply roller 17 and ink sheet winding roller 18 are detachably accommodated in an ink sheet housing 70 in the main body of the apparatus. Further, a reference numeral 19 designates a sensor for detecting the remaining quantity of ink sheet 14 and the speed at which ink sheet 14 is being conveyed; also, 20, an ink sheet sensor for detecting the presence of ink sheet 14; 21, a spring compressing the thermal head 13 against the platen roller 12 through the recording sheet 11 and ink sheet 14; and 22, a recording sheet sensor for detecting the presence of the recording sheet.

Subsequently, the structure of the reading unit 100 will be described.

In FIG. 3, a reference numeral 30 designates a light source for irradiating the original 32, and the reflected rays of light from original 32 are inputted into a CCD sensor 31 through an optical system (mirrors 50 and 51, and a lens 52), which are converted into electrical signals. The original 32 is conveyed by carrier rollers 53, 54, 55, and 56 driven by a motor (not shown) for conveying original in accordance with a speed at which the original 32 is being read. In this respect, a reference numeral 57 designates an original stacker. The plural sheets of originals 32 stacked on this stacker 57 are separated one by one by the cooperation of the carrier roller 54 and the pressurized separator 58 and conveyed to the reading unit 100.

A reference numeral 41 designates a control board constituting the major part of control unit 101. From the control board 41 various control signals are output to each of the units in the apparatus. Also, a reference numeral 105 designates a power supply to supply electric power to each unit; 106, a MODEM board unit; and 107, an NCU board unit having functions to relay telephone lines.

Further, FIG. 4 is a perspective view showing the details of mechanism to convey both ink sheet 14 and recording sheet 11.

In FIG. 4, a reference numeral 24 designates a motor for conveying the recording sheet which rotatively drives the platen roller 12 to convey the recording sheet 11 in the direction indicated by an arrow b which is opposite to the direction indicated by an arrow a; 25, also a motor for conveying ink sheet to convey the ink sheet 14 in the direction indicated by an arrow a by rotating a capstan roller 71 and a pinch roller 72; 26 and 27, transmission gears to transmit the rotation of the motor 24 for conveying recording sheet to the platen roller 12; 73 and 74, transmission gears to transmit the rotation of the motor 25 for conveying ink sheet to the capstan roller 71; and 75, a sliding clutch unit.

Here, by setting the ratio between gears 74 and 75 so as to make the length of the ink sheet 14 taken up by the winding roller 18 driven by the rotation of a gear 75*a* longer than the length of ink sheet conveyed by the capstan roller 71, the ink sheet 14 having been conveyed by the capstan roller 71 is reliably taken up by the winding roller 18. Then, an amount equivalent to the difference between the amount of ink sheet 14 taken up by the winding roller 18 and that of ink sheet 14 conveyed by the capstan roller 71 is absorbed by the sliding clutch unit 75. In this way, it is possible to restrict the fluctuation of the speed (amount) to convey ink sheet 14 caused by the changing diameter of the winding roller 18 as the winding advances.

FIG. 1 is a diagram showing the electrical connection between the control unit 101 and the recording unit 102 in a facsimile apparatus according to the present embodiment, and the unit which is common in the other figures is designated by the same reference number.

The thermal head 13 is a line head. Then, this thermal head 13 comprises a shift register 130 for inputting a one-line portion of the serial recording data 43*a* from the control unit 101 in synchronism with a shift clock 43*b* to retain such data; a latch circuit 131 for latching data in the shift register 130 by a latch signal 44; and a heat generating element 132 comprising a heat resistive unit for one line portion. Here, the heat resistive element 132 is divided into m blocks indicated by numerals 132-1 to 132-*m* for driving.

Also, a reference numeral 133 designates a temperature sensor installed on the thermal head 13 for detecting the temperature of thermal head 13. The output signal 42 of this temperature sensor 133 is inputted into the aforesaid CPU 113 after its A/D conversion having been executed in the control unit 101. Thus, the CPU 113 detects the temperature of the thermal head 13 to adjust the amplitude of the strobe signal 47 or the driving voltage of the thermal head 13 and changes the energy applied to the thermal head 13 in accordance with the characteristics of the ink sheet 14.

A reference numeral 134 designates a black dot counter to count the black dot numbers in one line, and 43*c*, a counter clear signal output from the control unit 101 to reset the value of the counter 134 to its zero position. When the shift clock 43*b* is output, this black dot counter 134 increments its counting value by 1 if the recording data 43*a* is a black data "1". This counting value is inputted into the control unit 101 through a signal line 134*a*. Therefore, the control unit 101 is allowed to detect the numbers of the black dot data contained in the recording data of one line which is about to be recorded when the black dot numbers are inputted thereto through the signal line 134*a* after the recording data of a one line portion has been transferred to the thermal head 13.

A reference numeral 116 designates a programmable timer. Its timing is set by the CPU 113, and when the timer is instructed to start its timing, the timer starts counting the time for the CPU 113 to output interrupt signals, time-out signals, and the like at each time indicated respectively.

In this respect, the characteristics (kinds) of the ink sheet 14 may be discriminated by the use of the aforesaid switch 103*a* in the operational unit 103 or the detection of marks and others printed on the ink sheet 14, or the detection of marks, cut-off, projection or the like provided for a cartridge and the like.

A reference numeral 46 designates a driver to receive the driving signal for the thermal head 13 from the control unit 101 to output the strobe signal 47 to cause the thermal head 13 to be driven by a unit of each block. In this respect, the driver 46 enables the energy applied to thermal head 13 to be changed by adjusting the voltage output to the source line 45 which supplies electric current to the heat generating element 132 of the thermal head 13 in accordance with an instruction from the control unit 101. A reference numeral 36 designates a driver including a motor for driving cutter to enable cutters 15 to be engaged for cutting; 39, a motor for exhausting sheet to drive exhaust sheet rollers 16.

Reference numerals 35, 48 and 49 designate motor drivers to drive the motor 39 for exhausting sheet, motor 24 for conveying recording sheet, and motor 25 for conveying ink sheet, respectively. In this respect, the motor 39 for exhausting sheet, motor 24 for conveying recording sheet, and motor 25 for conveying ink sheet are stepping motors in the present embodiment. These motors, however, are not limited thereto, and for example, DC motors or the like may also be usable.

<Description of Recording Processing (FIG. 1–FIG. 6)>

FIG. 5A-1, FIG. 5A-2 and FIG. 5B are flowcharts showing image recording processing for a one-page portion in a facsimile apparatus according to the present embodiment. The control program for executing this process is stored in the ROM 114 in control unit 101.

This processing is started when the image recording operation is ready to start with the one-line portion of the image data stored in the line memory 110 for an image to be recorded. Here, it is assumed that the control unit 101 has discriminated by the functions of the switch 103*a* and others that the multi-ink sheet is installed.

First, at the step S1, the black dot counter 134 is cleared to the value "0" by the counter clear signal 43*c*. Then, at the step S2, the value of the timer 116 is cleared to prepare for timing the recording interval. Subsequently, the process proceeds to the step S3 to output by serial signals the recording data of a one line portion to the shift register 130. When the transfer of the recording data of the one line portion has been completed, a latch signal 44 is output at the step S4 to store the recording data of the one line portion in the latch circuit 131. Then, the process proceeds to the step S5 to input the black dot numbers, which have been transferred to the thermal head 13, into the control unit 101 through the signal line 134*a* for its storage in the black dot number memory 117 in the RAM 115.

Next, the process proceeds to the step S6 to cause the motor 25 for conveying ink sheet to be driven to convey the ink sheet 14 for a 1/n line portion. More precisely, as shown in a timing chart shown in FIG. 6, which will be described later, the conveyance driving for the ink sheet 14 is started by the timing just before each block of the thermal head 13 is energized, and the excitation phase of the motor 25 for conveying ink sheet is switched. Then, the process proceeds to the step S7 to convey the recording sheet for the one portion. In this case, too, the excitation phase of the motor 24 for conveying recording sheet is switched by the timing just before the heat generating elements 132-1 and 132-3 of the thermal head 13 are energized to convey the recording sheet 11 as described in FIG. 6 in detail.

In this respect, the length of the one line in the subscanning direction (the conveying direction of the recording sheet) is set for approximately (1/7.7) mm in the facsimile apparatus according to the present embodiment, and the conveying amounts of the recording sheet 11 and ink sheet 14 are defined by changing the excitation pulse numbers of the motor 24 for conveying recording sheet and motor 25 for conveying ink sheet, respectively.

Thus, the process proceeds to the step S8 to allow one of the blocks of the heat generating element 132 of the thermal head 13 to be energized to perform the image recording, and at the step S9, whether or not the entire blocks of the heat generating element 132 of the thermal head 13 is examined. If the entire blocks have not yet been energized, the process proceeds to the step S10. If the entire blocks of the thermal heat 13 have been energized, the process proceeds to the step S16.

At the step S10, whether or not the generation of the next line data has been completed (whether the receiving of the signals for the next line as well as its decoding has been completed or not) is examined. If the generation of the next line data has been completed, the process proceeds to the step S11. Otherwise, the process proceeds to the step S14. At the step S11, whether the process is for the first one subsequent to the completion of the data generation or not is examined. If so, the process proceeds to the step S12 to clear the black dot counter 134. Then, proceeding to the step S13, the process is conducted so as to transfer the next line data to be recorded to the shift register 130 of the thermal head 13. Also, in this way, the black dot numbers in that particular line are counted by the black dot counter 134.

Here, at the step S10, if the generation of the next line data has not yet been completed, the process proceeds to the step S14 to receive the signals for such line data for the decoding processing. Then, at the step S15, whether the time has elapsed to energize the black or not is examined. If the energizing time (approximately 1,200 μs) has not elapsed as yet, then the process returns to the step S10. If, however, the energizing time has elapsed the process returns to the step S8 to execute the energizing processing for the next block. Here, in the present embodiment, the thermal head 13 is divided into four blocks (m=4) to be energized for its driving, and the required time for recording one line is approximately 5.0 ms (1,200 μs×4 blocks).

At the steps S9, when the entire blocks have been energized to perform the one line recording, the process proceeds to the step S16 to examine whether or not the predetermined conditions are satisfied to convey the ink sheet 14 on the basis of the elapsed time since the completion of the recording of the last line information, which has been measured by the timer 116, and the black dot numbers (the value of the black dot number memory 117) contained in the recorded line information. This predetermined condition will be described later in detail. If the predetermined conditions have been satisfied, the process proceeds to the step S17 to drive the motor 25 for conveying ink sheet, so that the ink sheet 14 is conveyed excessively by an amount of ½ n line. On the other hand, if the predetermined conditions are not satisfied, the process proceeds to the step S18 without any performance of conveying the ink sheet 14.

At the step S18, whether a one-page portion image recording processing has been terminated or not is examined. If the one-page portion recording processing has not yet been terminated, the process proceeds to the step S19. On the other hand, if the one-page portion image recording has been terminated, the process proceeds to the step S26 to convey the recording sheet 11 towards the exhaust roller 16 (16*a* and 16*b*) by a predetermined amount. Then, at the step S27, the cutters 15 (15*a* and 15*b*) are driven to engage for cutting the recording sheet 11 by the one-page unit. Subsequently, by the exhaust rollers 16, the recording sheet 11 thus cut is exhausted to the outside of the apparatus and at the same time, at the step S28, the remaining recording sheet 11 is retracted for an amount equivalent to the distance between the thermal head 13 and the cutters 15 to terminate the recording processing for the one page.

If, meanwhile, the one-page portion image recording processing has not yet been terminated at the step S18, the process proceeds to the step S19 to reset the timer 116 for measuring the recording intervals. Then, advancing to the step S20, the process is executed to examine whether or not the next line data has already been transferred to the thermal head 13. If the transfer has been completed, the process returns to the step S4 to repeat the execution of the aforesaid processing.

At the step S20, if the transfer of the next line data to the thermal head 13 has not been completed as yet, the process proceeds to the step S21 to examine whether or not the generation of the next line data has been terminated. Then, if the generation has not been terminated, the process advances to the step S22 to continue receiving the signals for the next line data and its decoding processing. At the step S21, if the generation of the next line data has been terminated, the process proceeds to the step S23 to examine whether the current processing is the initial one subsequent to the generation of the next line data or not as in the case of the step S11 as described earlier, and if the processing is an initial one, the black dot counter 134 is cleared at the step S24 as in the case of the step S12. Then, the process proceeds to the step S25 to transfer the next line data thus generated to the thermal head 13 and returns to the step S4.

<Description of Ink Sheet Conveyance Conditions>

Figure 5D:
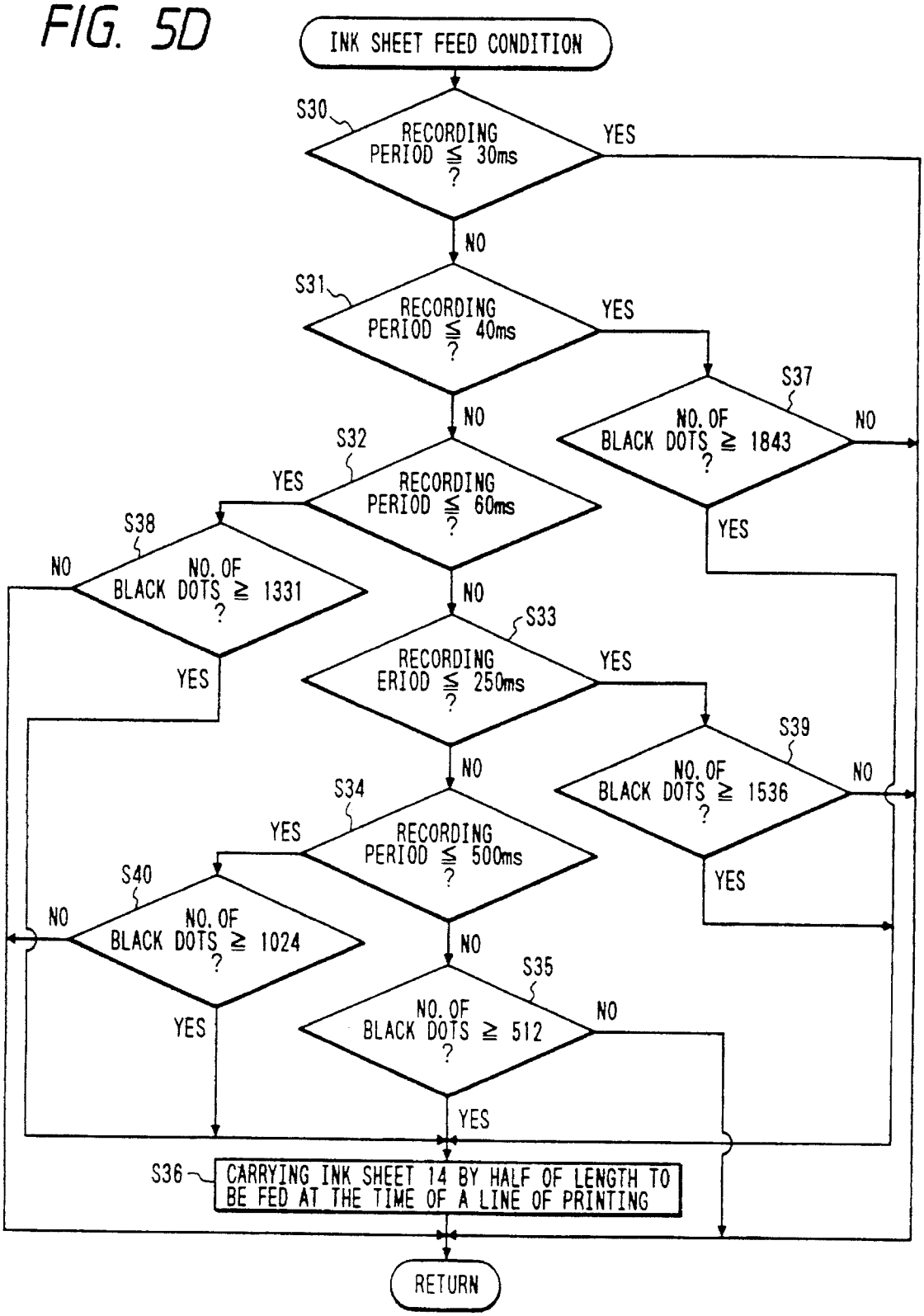
FIG. 5D is a flowchart showing the judgment processing on the basis of the conditions shown in FIG. 5C.

FIG. 5C is a view illustrating the conveyance conditions determined for the ink sheet 14 at the aforesaid step S16. FIG. 5D is a flowchart showing the judgment processing at the aforesaid step S16 and step S17 and the conveyance processing of the ink sheet 14. In this respect, the recording cycle in FIG. 5C represents an elapsed time since the termination of the last line recording.

In FIG. 5C, when the recording cycle t is 30 ms or less, the ink sheet 14 is not conveyed. Also, when the recording cycle t is 30 ms or more and 40 ms or less, the ink sheet 14 is conveyed excessively by the amount corresponding to a ½ of the conveyance length of the ink sheet defined for the current recording mode subsequent to the termination of the current line recording if the black dot numbers in the currently recorded line exceed 1,843 (this being a black rate of more than 90% in the case of a recording data in a B4 size). Thereafter, the black dot numbers for each of the recording cycles are mentioned lilkewise, and whether the ink sheet 14 should be conveyed excessively or not is decided on the basis of these conditions.

In FIG. 5D, at the step S30 at first, the timing value of the timer 116 is read to discriminate whether or not the recording cycle is 30 ms or less, and if the cycle is 30 ms or less, then the processing is terminated as it is. If the cycle is more than 30 ms, then the process advances to the step S31 to examine whether or not the recording cycle is 40 ms or less. If the cycle is 40 ms or less, then the process proceeds to the step S37 to examine whether or not the black dot numbers in the recording data in the currently recorded line exceed 1,843. If the black dot numbers are more than that number, the process advances to the step S36 to convey the ink sheet 14 excessively by the amount corresponding to a ½ of the ink sheet conveyance length for a one line in the current conveyance mode (in the present embodiment, for example, a ½ n line). This step S36 corresponds to the processing at the aforesaid step S17. In this respect, if the black dot numbers are 1,843 or less, no particular process is executed then.

If the recording cycle t exceeds 40 ms, the process proceeds to the step S32 to examine whether or not the recording cycle is 60 ms or less. With the condition of 40 ms<t≦60 ms, the process advances to the step S38 to examine whether or not the dot numbers stored in the black dot number member 117 is 1,331 or more. If the dot numbers are 1,331 or more, the ink sheet is conveyed at the step S37. If the numbers are less than 1,331, no particular processing is executed then. Likewise, if the recording cycle t is in the condition of 60 ms<t≦250 ms, the process proceeds from the step S33 to the step S39 to examine whether or not the value of the black dot number memory 117 is 1,536 or more. If the value is 1,536 or more, the process advances to the step S36. Otherwise, the process returns as it is. Also, the recording cycle t is in the condition of 250 ms<t≦5,000 ms, the process advances from the step S34 to the step S40, and if the black dot numbers are 1,024 or more, then the process proceeds to the step S36. Also, if the condition is of 500 ms<t, the process advances to the step S35, and if the black dot numbers are 512 or more, then the process proceeds to the step S36 to convey the ink sheet 14 excessively.

In this respect, the judgment conditions thereby to decide whether or not the ink sheet 14 should be conveyed on the basis of these above-mentioned recording cycles and the black dot numbers in the corresponding one line have been obtained from the experimental results.

Hence, according to the present embodiment, when the predetermined conditions made up with the elapsed time since the completion of the recording of the last line information and the black dot numbers contained in the currently recorded one line are satisfied, the aforesaid ink sheet 14 is conveyed for a predetermined length, without conveying the recording sheet 11, subsequent to the termination of the current line recording.

In this way, it is possible to improve the traveling ability of the ink sheet 11 as well as to minimize the force required for shearing ink from ink in the ink layer. Also, it is possible to improve the separation between the ink sheet 14 and recording sheet 11 when the ink sheet 14 and recording sheet 11 are conveyed for the next recording.

Figure 6:
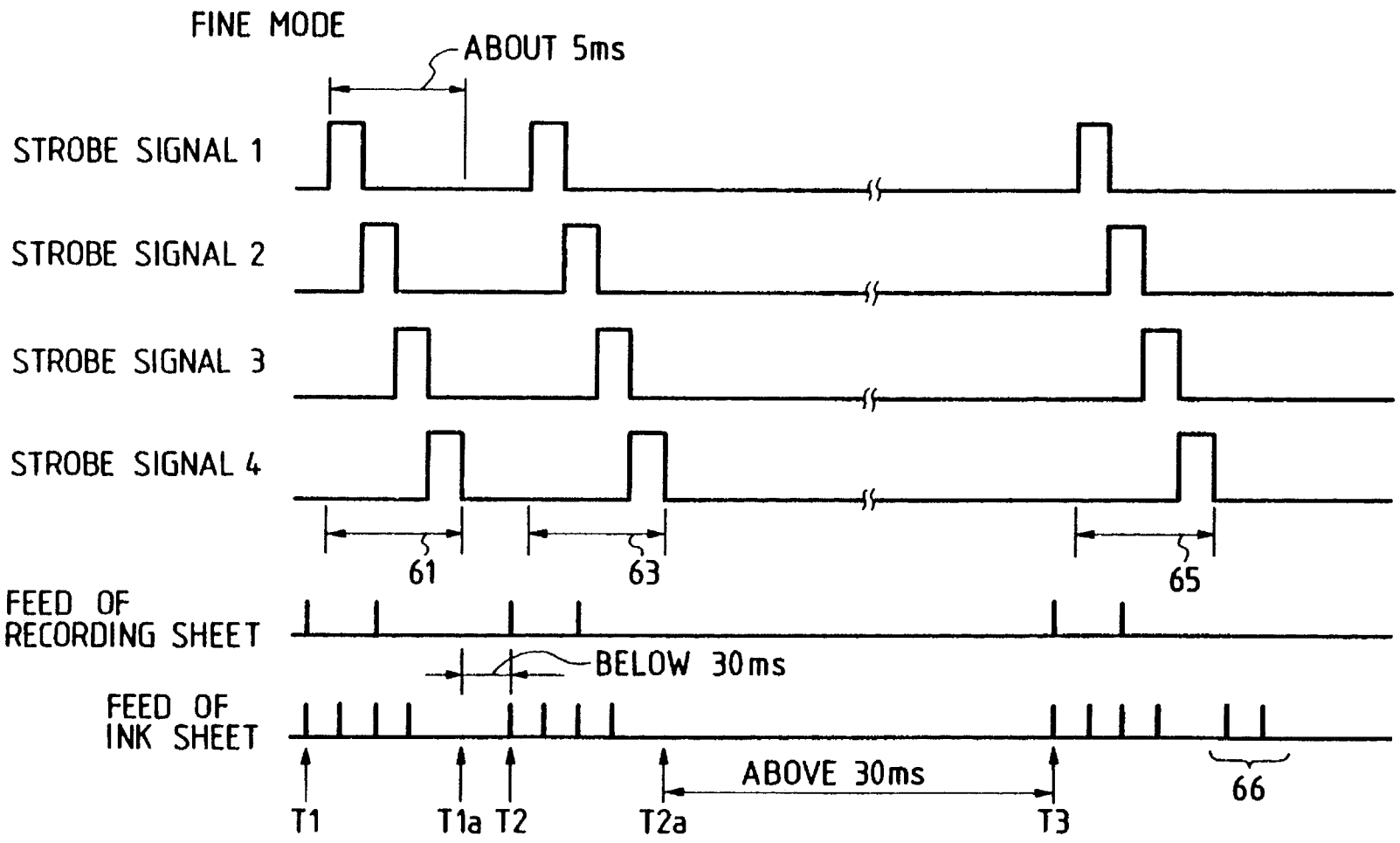
FIG. 6 is a timing chart showing the timing for energizing the thermal head as well as for conveying the ink sheet and recording sheet in the recording processing in the first embodiment.

FIG. 6 is a timing chart showing the timing to energize the thermal head 13 in the image recording processing of the present embodiment and the timing to convey the ink sheet 14 and recording sheet 11. Here, the heat resistive unit 132 of the thermal head 13 is divided into four blocks to be energized as described earlier, and each of the strobe signals 1 to 4 corresponds to each of the block energizing signals of the heat resistive unit 132 of the thermal head 13.

Here, in this respect, the fine mode recording operation is represented, and when the pulses are generated to indicate the timings to convey the ink sheet 14 and recording sheet 11, the excitation phase (a ½ of a half step portion) of the respective motor is switched for the conveyance. Here, the recording sheet 11 is conveyed for (1/7.7) mm at two half steps while the ink sheet 14 is conveyed for (1/7.7 n) mm at four half steps, where n=5 in this respect.

The timing T1 indicates that the next line recording data have been transferred to the thermal head 13 completely, and that the next line recording can be executed. At the timing T1, the excitation phase of each motor is switched to convey the ink sheet 14 and recording sheet 11 and each of the motors is driven for a half step. The motors are actuated before the recording operation is started because there is a temporal delay between the switching of the excitation phases of the motors and the conveyance of the recording sheet 11 and ink sheet 14.

Then, as indicated by a reference numeral 61, the recording is performed for a one line. The timing T2 indicates that the next line recording data has been transferred to the thermal head 13, and that the recording for the next line (63) is ready. At this time, the judgment is made on the basis of the recording cycle (a period from T1*a* to T2*a*), which is the time having elapsed from the termination of the one line recording to the next line recording becoming ready, and the black dot numbers contained in the line information recorded by the recording processing 63. Now, it is assumed, for example, that the elapsed time from the timing T1*a* to the timing T2 is 30 ms or less. Then, any excessive conveyance of the ink sheet 14 is not executed after the termination of the recording processing 63.

On the other hand, in the recording processing 65 which begins at the timing T3, the ink sheet 14 is conveyed for a ½ n line portion [in the present embodiment, (½)×(1/7.7)×1/n) mm] subsequent to the termination of the recording processing 65 as represented by a numeral 66, provided that the elapsed time is at least 30 ms or more from the termination point T2*a* of the last line recording processing 63 to the starting time T3 of the current line recording operation 65, and that the black dot numbers in the one line recorded by the recording processing 65 satisfy the condition shown in FIG. 5C.

Hence, according to the present embodiment, there is an effect that the ink sheet and recording medium can be separated reliably after the image recording by conveying the ink sheet for a predetermined length subsequent to the termination of the current line recording on the basis of the time interval after the termination of the last line recording as well as of black dot numbers contained in the line information recorded on the current line.

In this respect, the ink sheet conveyance after the termination of the current line recording is controlled on the basis the elapsed time after the termination of the last line recording and black dot numbers contained in the current line. In addition to this, it is also possible to control the ink sheet conveyance after the termination of the current line recording in accordance with the difference between the black numbers in the last line and the current line.

Figure 7:
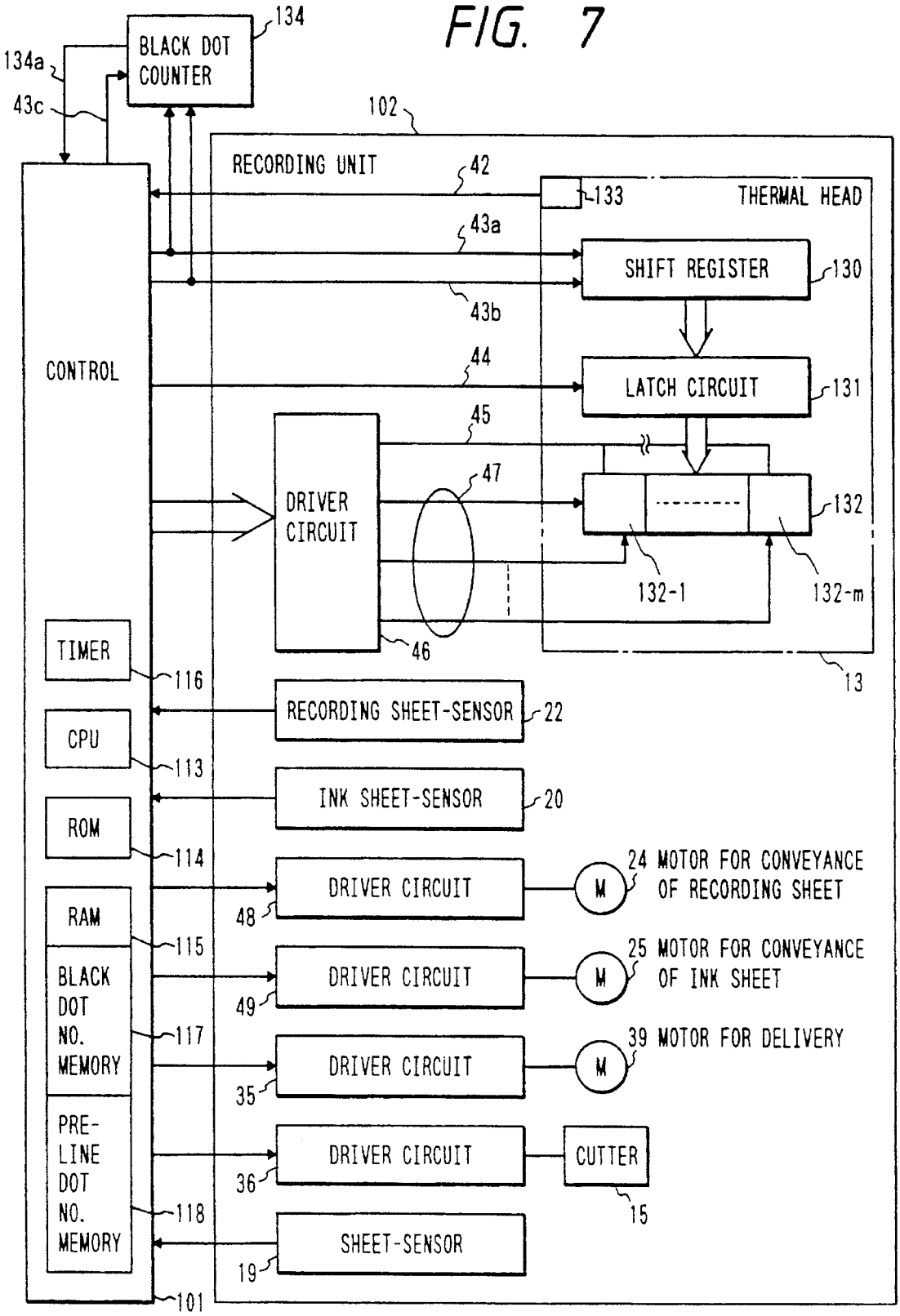
FIG. 7 is a block diagram showing the electrical connection between the control unit and recording unit in a facsimile apparatus according to a second embodiment of the present invention.

FIG. 7 is a block diagram showing the electrical connection between the control unit and recording unit in a facsimile apparatus according to a second embodiment of the present invention. In this respect, the schematic structure of the facsimile apparatus in the present embodiment is the same as the structure shown in FIG. 2 through FIG. 4, and the description thereof will be omitted.

In FIG. 7, the constituents having the same reference numerals appearing in FIG. 1 are the same constituents, and what differs in the present embodiment from the one in FIG. 1 is that there is further provided an area in the RAM 115 for storing the black dot number data of the last line.

<Description of Recording Processing in the Present Embodiment (FIG. 2–FIG. 4, and FIG. 7–FIG. 9)>

FIG. 8A-1, FIG. 8A-2 and FIG. 8B are flowcharts showing image recording processing for a one-page portion in a facsimile apparatus according to the present embodiment. The control program for executing this process is stored in the ROM 114 in the control unit 101.

This processing is started when the image recording operation is ready to start with the one-line portion of the image data stored in the line memory 110 for an image to be recorded. Here, it is assumed that the control unit 101 has discriminated by the functions of the switch 103*a* and others that the multi-ink sheet is installed.

First, at the step S101, the black dot counter 134 is cleared to the value "0" by the counter clear signal 43*c* and at the same time, the black dot number memory 117 of the RAM 115 and a last line black dot number memory 118 are cleared. Then, at the step S102, the value of the timer 116 is cleared to prepare for timing the recording interval. Subsequently, the process proceeds to the step S103 to output in serial the recording data of a one line portion to the shift register 130. When the transfer of the recording data of the one line portion has been completed, a latch signal 44 is output at the step S104 to store the recording data of the one line portion in the latch circuit 131.

Then, the process proceeds to the step S105 to transfer the value of the black dot number memory 117 to the last line black dot number memory 118 and at the same time, to input the black dot numbers in the one line data transferred to the thermal head 13 through the signal line 134*a* for its storage in the black dot number memory 117 of the RAM 115. Hence, in the black dot number memory 117, the black dot numbers in a proceeding one line to be recorded then are stored while in the last line black dot number memory 118, the black dot numbers having been recorded in the immediately preceding one line are stored.

Next, the process proceeds to the step S106 to cause the motor 25 for conveying ink sheet to be driven to convey the ink sheet 14 for a 1/n line portion. More precisely, as shown in a timing chart shown in FIG. 9, which will be described later, the conveyance driving for the ink sheet 14 is started by the timing just before each block of the thermal head 13 is energized, and the excitation phase of the motor 25 for conveying ink sheet is switched. Then, the process proceeds to the step S107 to convey the recording sheet 11 for the one portion. In this case, too, the excitation phase of the motor 24 for conveying recording sheet is switched by the timing just before the heat generating elements 132-1 and 132-3 of the thermal head 13 are energized to convey the recording sheet 11 as described in FIG. 9 in detail.

In this respect, the length of the one line is set for approximately 1/7.7 mm in the facsimile apparatus according to the present embodiment, and the conveying amounts of the recording sheet 11 and ink sheet 14 are defined by changing the excitation pulse numbers of the motor 24 for conveying recording sheet and motor 25 for conveying ink sheet, respectively.

Thus, the process proceeds to the step S108 to allow one of the blocks of the heat generating element 132 of the thermal head 13 to be energized to perform the image recording, and at the step S109, whether or not the entire blocks of the heat generating element 132 of the thermal head 13 is examined. If the entire blocks have not yet been energized, the process proceeds to the step S110. If the entire blocks of the thermal head 13 have been energized, the process proceeds to the step S116.

At the step S110, whether or not the generation of the next line data has been completed (whether the receiving of the signals for the next line as well as its decoding has been completed or not) is examined. If the generation of the next line data has been completed, the process proceeds to the step S111. Otherwise, the process proceeds to the step S114. At the step S111, whether the process is for the first one subsequent to the completion of the data generation or not is examined. If so, the process proceeds to the step S112 to clear the black dot counter 134. Then, proceeding to the step S113, the process is conducted so as to transfer the next line data to be recorded to the thermal head 13. In this way, the black dot numbers in that particular line are counted by the black dot counter 134.

Here, at the step S110, if the generation of the next line data has not yet been completed, the process proceeds to the step S114 to receive the signals for such line data for the decoding processing. Then, at the step S115, whether the time has elapsed to energize the black or not is examined. If the energizing time (approximately 1,200 μs) has not elapsed as yet, then the process returns to the step S110. If, however, the energizing time has elapsed the process returns to the step S108 to execute the energizing processing for the next block. Here, in the present embodiment, the thermal head 13 is divided into four blocks (m=4) to be energized for its driving, and the required time for recording one line is approximately 5.0 ms (1,200 μs×4 blocks).

At the steps S109, when the entire blocks have been energized to perform the one line recording, the process proceeds to the step S116 to examine the elapsed time since the completion of the recording of the last line information, which has been measured by the timer 116, the black dot numbers (the value of the black dot number memory 117) recorded in the current line, and the value obtainable by subtracting the black dot numbers in the last line (the value of the memory 118) from the black dot numbers in the currently recorded line (the value of the memory 117) to judge whether or not these values are more than the predetermined values required to satisfy the predetermined conditions for conveying the ink sheet 14. The predetermined conditions in this respect will be described later in detail. If the predetermined conditions are satisfied, then the process proceeds to the step S117 to drive the motor 25 for conveying ink sheet to convey the ink sheet 14 excessively for a ½ n line. On the other hand, if the predetermined conditions are not satisfied, the process advances to the step S118 without conveying the ink sheet 14.

At the step S118, whether a one-page portion image recording processing has been terminated or not is examined. If the one-page portion recording processing has not yet been terminated, the process proceeds to the step S119. On the other hand, if the one-page portion image recording has been terminated, the process proceeds to the step S126 to convey the recording sheet 11 towards the exhaust roller 16 (16*a* and 16*b*) by a predetermined amount. Then, at the step S127, the cutters 15 (15*a* and 15*b*) are driven to engage for cutting the recording sheet 11 by the one-page unit. Subsequently, by the exhaust rollers 16, the recording sheet 11 thus cut is exhausted to the outside of the apparatus and at the same time, at the step S128, the remaining recording sheet 11 is retracted for an amount equivalent to the distance between the thermal head 13 and the cutters 15 to terminate the recording processing for the one page.

If, meanwhile, the one-page portion image recording processing has not yet been terminated at the step S118, the process proceeds to the step S119 to reset the timer 116 for measuring the recording intervals. Then, advancing to the step S120, the process is executed to examine whether or not the next line data has already been transferred to the thermal head 13. If the transfer has been completed, the process returns to the step S104 to repeat the execution of the aforesaid processing.

At the step S120, if the transfer of the next line data to the thermal head 13 has not been completed as yet, the process proceeds to the step S121 to examine whether or not the generation of the next line data has been terminated. Then, if the generation has not been terminated, the process advances to the step S122 to continue receiving the signals for the next line data and its decoding processing. At the step S121, if the generation of the next line data has been terminated, the process proceeds to the step S123 to examine whether the current processing is the initial one subsequent to the generation of the next line data or not as in the case of the step S111 as described earlier, and if the processing is an initial one, the black dot counter 134 is cleared at the step S124 as in the case of the step S112. Then, the process proceeds to the step S125 to transfer the next line data thus generated to the thermal head 13 and returns to the step S104.

<Description of Ink Sheet Conveyance Conditions>

Figures 1, 8A:
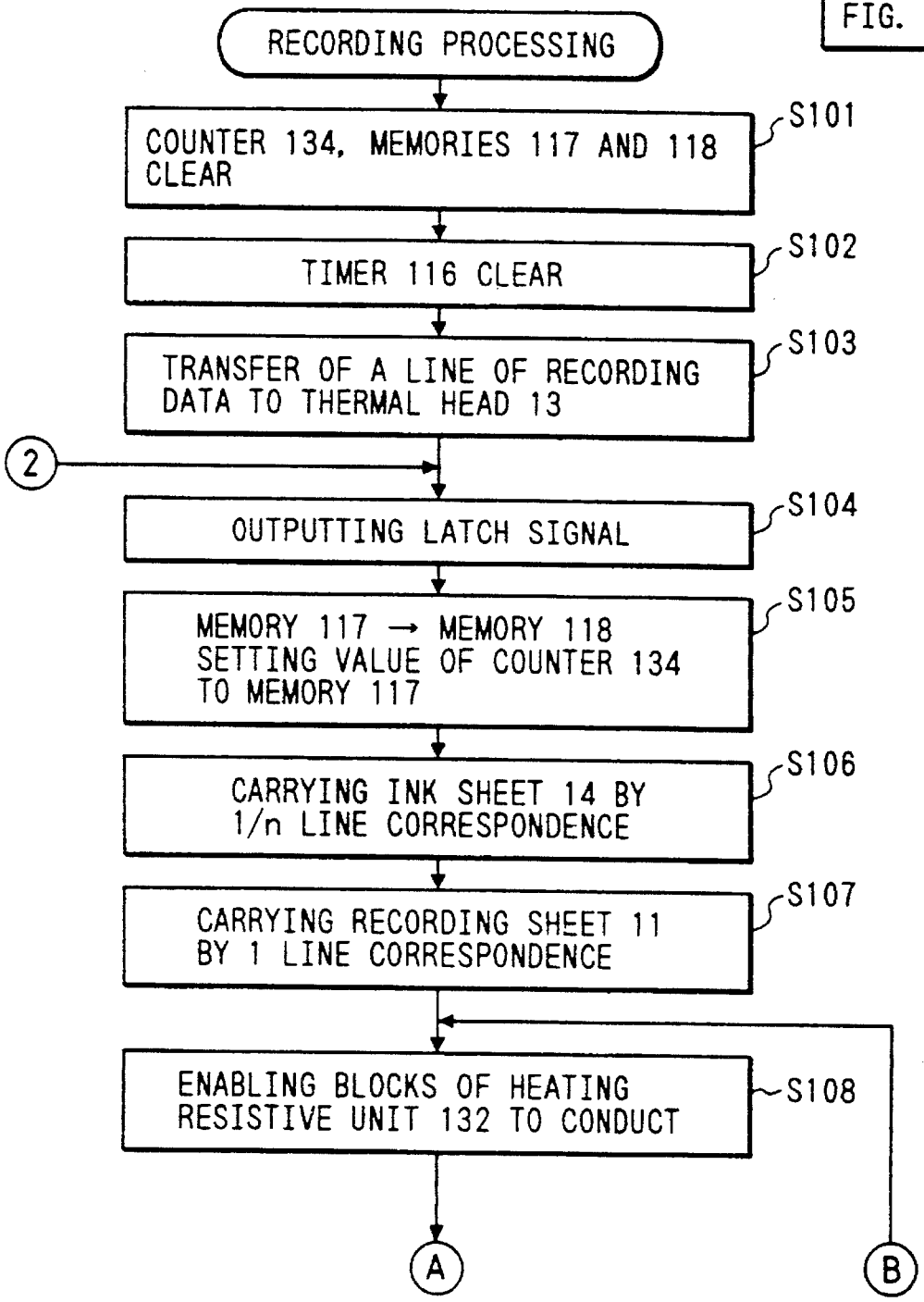
FIG. 8A is a block diagram showing that FIG. 8A-1 and FIG. 8A-2 are to be read as connected flowcharts.
Figures 2, 8A:
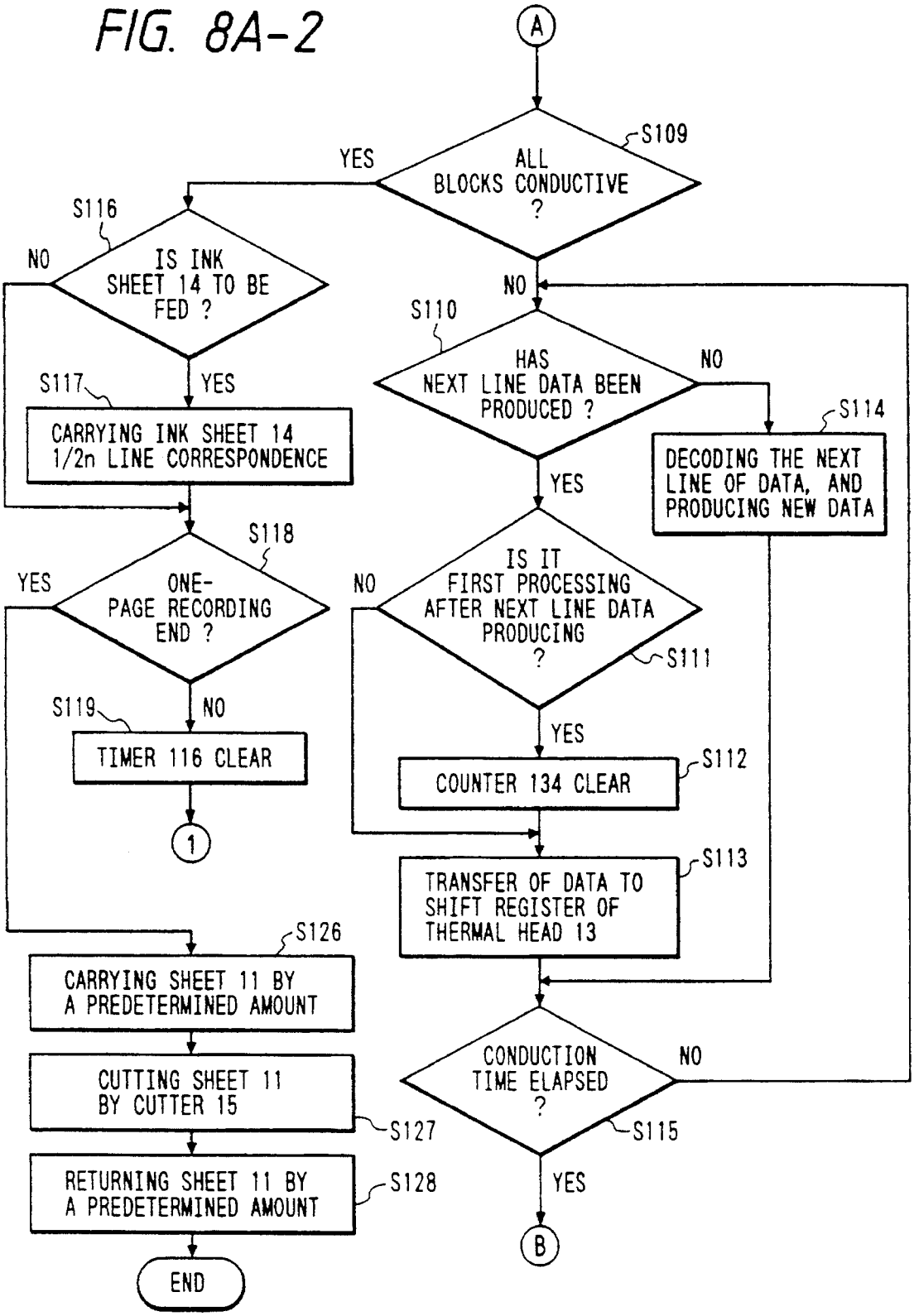
Figure 8B:
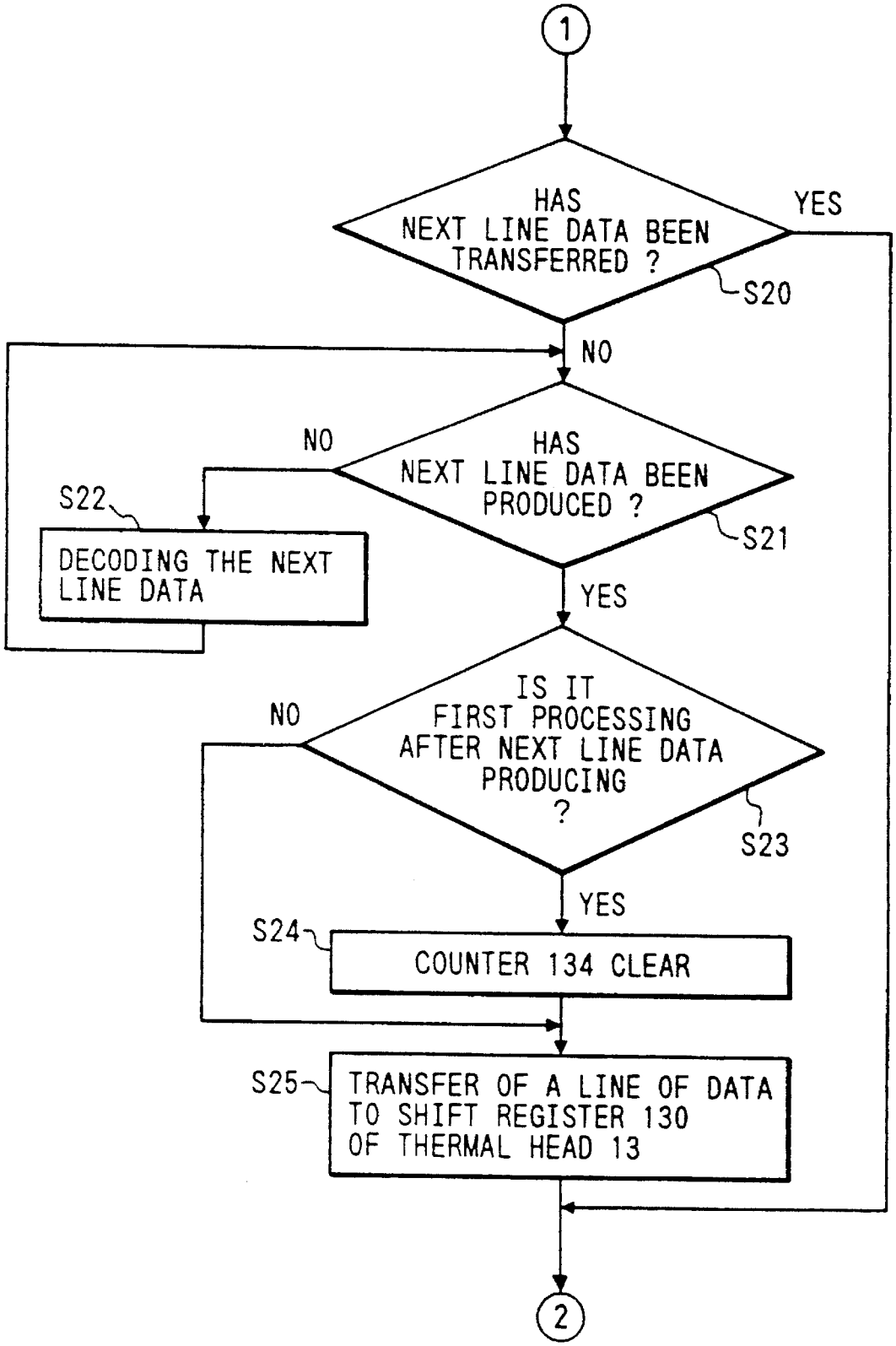
Figure 8D:
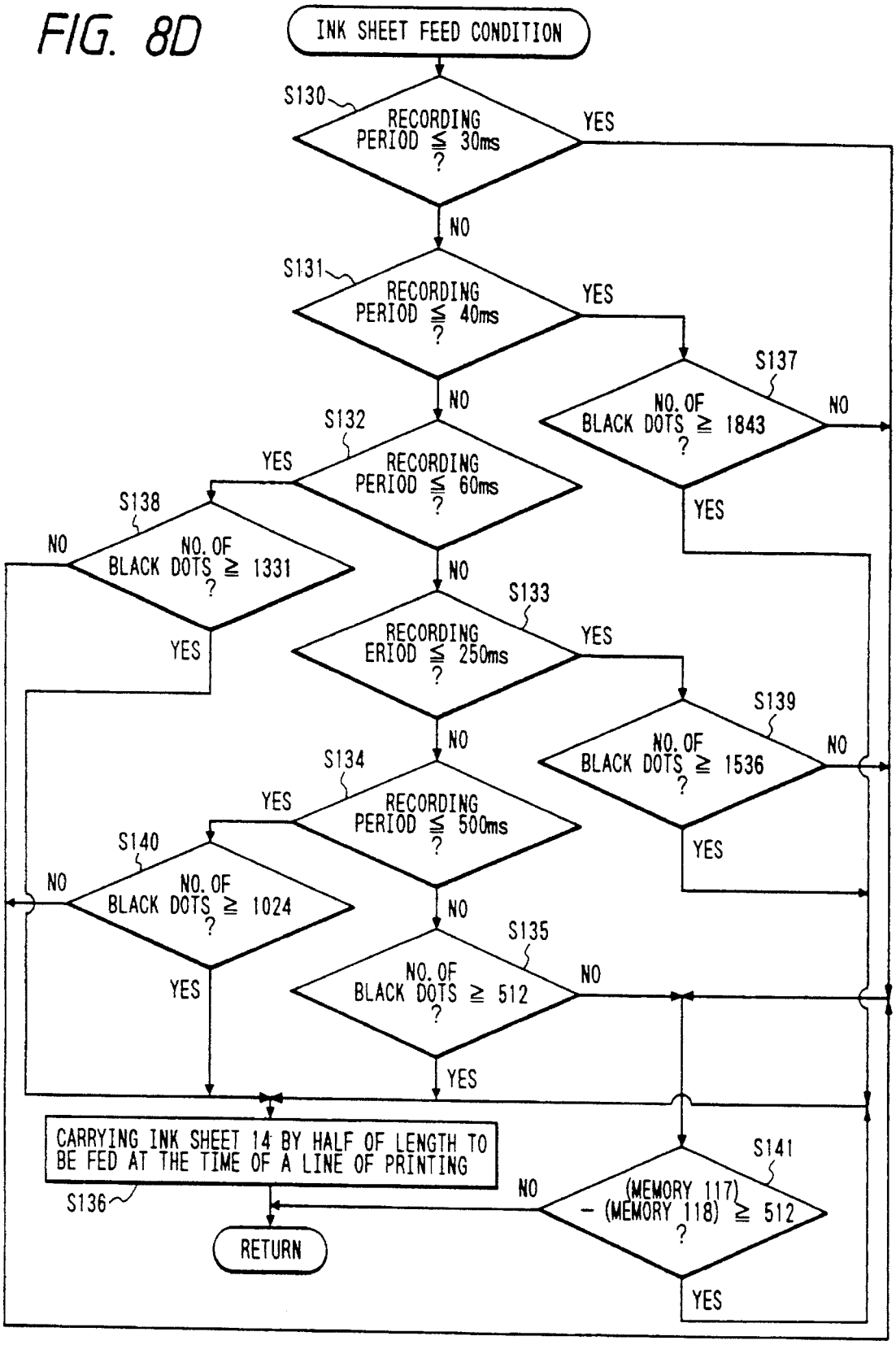
FIG. 8D is a flowchart showing the judgment processing on the basis of the conditions shown in FIG. 8C.

FIG. 8C is a view illustrating the conveyance conditions determined for the ink sheet 14 at the aforesaid step S116. FIG. 8D is a flowchart showing the judgment processing at the aforesaid step S116 and step S117 and the conveyance processing of the ink sheet 14. In this respect, the recording cycle in FIG. 8C represents an elapsed time since the termination of the last line recording.

In FIG. 8C, when the recording cycle t is 30 ms or less, the ink sheet 14 is not conveyed. Also, when the recording cycle t is 30 ms or more and 40 ms or less, the ink sheet 14 is conveyed excessively by the amount corresponding to a ½ of the conveyance length of the ink sheet defined for the current recording mode if the black dot numbers in the currently recorded line exceed 1,843 (this being a black rate of more than 90% in the case of a recording data in a B4 size). Thereafer, the black dot numbers for each of the recording cycles are mentioned likewise, and whether the ink sheet 14 should be conveyed excessively or not is decided on the basis of these conditions. Also, if the current condition does not conform to any one of these conditions, then the black dot numbers recorded in the last line (the value of the last line black dot number memory 118) are subtracted from the black dot numbers recorded in the current line (the value of the black dot number memory 117), and if the value thus obtained is 512 or more, the ink sheet 14 is conveyed excessively.

Now, this judgment processing will be described.

In FIG. 8D, at the step S130 at first, the timing value of the timer 116 is read to discriminate whether or not the recording cycle is 30 ms or less, and if the cycle is 30 ms or less, the process advances to the step S141 to obtain the difference between the black dot numbers recorded in the current line and the black dot numbers recorded in the last line, and to terminate the processing as it is if the value thus obtained is less than 512. If, however, the difference is 512 or more, the process proceeds to the step S136. Then, at the step S136, the ink sheet 14 is conveyed excessively by the amount corresponding to a ½ of the ink sheet conveyance length for a one line in the current conveyance mode (in the present embodiment, for example, a ½ n line). This step S136 corresponds to the processing at the aforesaid step S117. In this respect, as a typical example to satisfy the conditions at the step S141, there may be conceivable a case where the last line recording has been for ordinary characters and the like and the current line recording is for a horizontal line for a ruled mark or the like. With the processing at this step, however, it is possible to prevent the adhesion of the ink sheet 14 to the recording sheet 11 which is apt to occur in recording the horizontal line for the ruled mark.

On the other hand, at the step S130, if the recording cycle is 30 ms or more, the process proceeds to the step S131 to examine whether or not the recording cycle is 40 ms or less. If the recording cycle is less than 40 ms, then the process advances to the step S137 to examine whether or not the black dot numbers of the recording data in the current line is 1,843 or more, and if the black dot numbers exceeds that number, the proceeds to the step S136. If, however, the black dot numbers are less than 1,843, the process advances to the step S141.

If the recording cycle t exceeds 40 ms at the step S131, then the process proceeds to the step S132 to examine whether or not the recording cycle is 60 ms or less. With the condition of 40 ms<t≦60 ms, the process advances to the step S138 to examine whether or not the dot numbers stored in the black dot number memory 117 is 1,331 or more. If the dot numbers are 1,331 or more, the ink sheet is conveyed at the step S136. If the numbers are less than 1,331 the process proceeds to the step S141. Likewise, if the recording cycle t is in the condition of 60 ms<t≦250 ms, the process proceeds from the step S133 to the step S139 to examine whether or not the value of the black dot number memory 117 is 1,536 or more. If the value is 1,536 or more, the process advances to the step S136. Otherwise, the process proceeds to the step S141, Also, the recording cycle t is in the condition of 250 ms<t≦5,000 ms, the process advances from the step S134 to the step S140, and if the black dot number are 1,024 or more, then the process proceeds to the step S136. Also, if the condition is of 500 ms<t, the process advances to the step S135, and if the black dot number are 512 or more, then the process proceeds to the step S136 to convey the ink sheet 14 excessively.

In this respect, the judgment conditions thereby to decide whether or not the ink sheet 14 should be conveyed on the basis of the above-mentioned recording cycles and the black dot numbers recorded in the corresponding one line, and of the difference between the black dot numbers in the current line and the recorded black dot numbers in the last line have been obtained from the experimental results.

Hence, according to the present embodiment, when the predetermined conditions made up with the elapsed time since the completion of the recording of the last line information and the black dot numbers contained in the currently recorded one line are satisfied, or when the black dot numbers recorded in the current line are greater than the black dot numbers recorded in the last line by 512 or more, the aforesaid ink sheet 14 is conveyed for a predetermined length, without conveying the recording sheet 11, subsequent to the termination of each recording in the current line.

In this way, it is possible to improve the traveling ability of the ink sheet 11 as well as to minimize the force required for shearing ink from ink in the ink layer. Also, it is possible to improve the separation between the ink sheet 14 and recording sheet 11 when the ink sheet 14 and recording sheet 11 are conveyed for the next recording.

Figure 9:
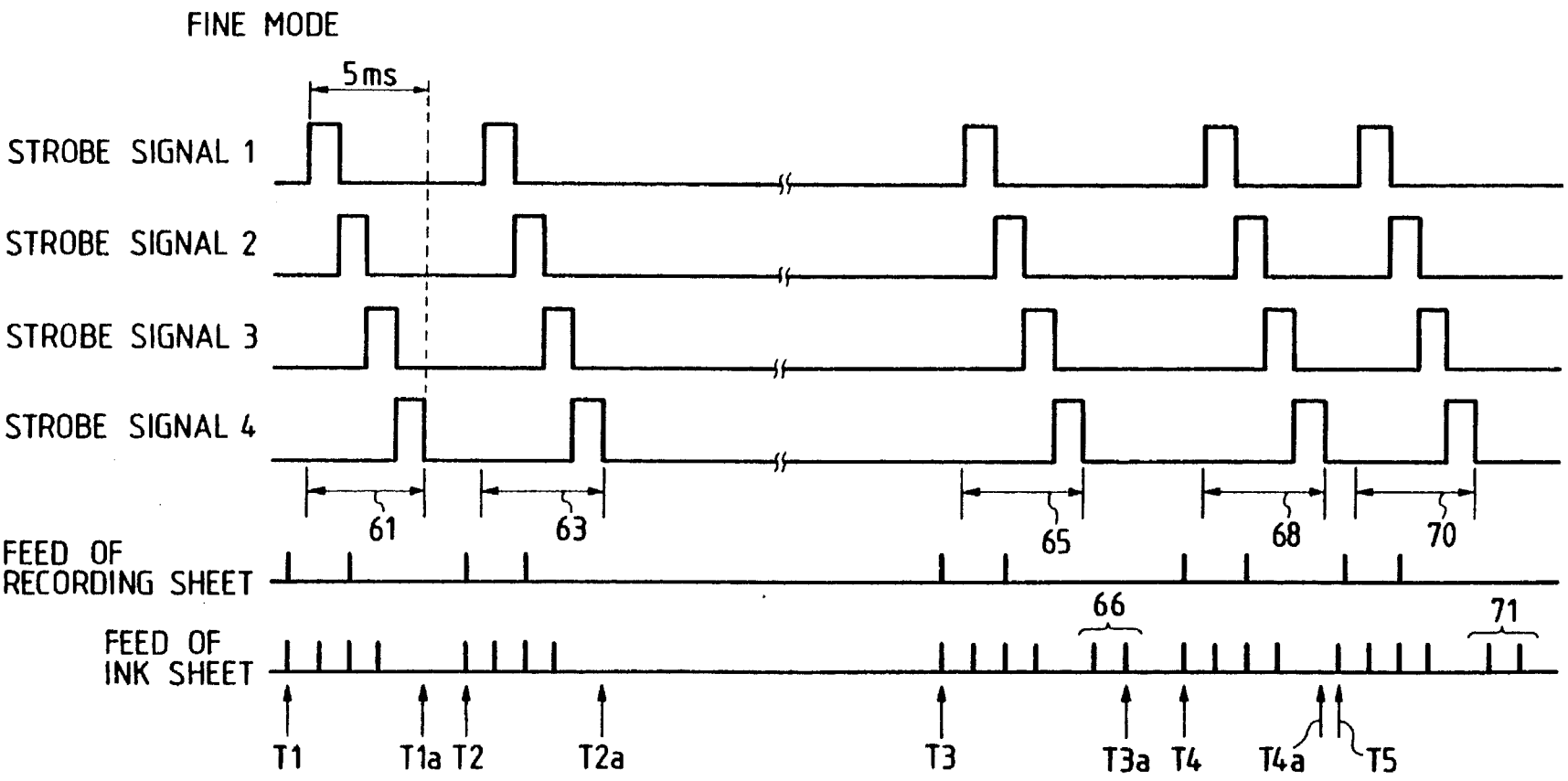
FIG. 9 is a timing chart showing the timing for energizing the thermal head as well as for conveying the ink sheet and recording sheet in the recording processing the second embodiment.

FIG. 9 is a timing chart showing the timing to energize the thermal head 13 in the image recording processing of the present embodiment and the timing to convey the ink sheet 14 and recording sheet 11. Here, the heat resistive unit 132 of the thermal head 13 is divided into four blocks to be energized as described earlier, and each of the strobe signals 1 to 4 corresponds to each of the block energizing signals of the heat resistive unit 132 of the thermal head 13.

Here, in this respect, the fine mode recording operation is represented, and when the pulses are generated to indicate the timings to convey the ink sheet 14 and recording sheet 11, the excitation phase (a ½ of a half step portion) of the respective motor is switched for the conveyance. Here, the recording sheet 11 is conveyed for ($1/7.7$) mm at two half steps while the ink sheet 14 is conveyed for ($1/7.7$ n) mm at four half steps, where n=5 in this respect.

The timing T1 indicates that the next line recording data have been transferred to the thermal head 13 completely, and that the next line recording can be executed. At the timing T1, the excitation phase of each motor is switched to convey the ink sheet 14 and recording sheet 11 and each of the motors is driven for a half step. The motors are actuated before the recording operation is started because there is a temporal delay between the switching of the excitation phases of the motors and the conveyance of the recording sheet 11 and ink sheet 14.

Subsequently, as indicated by a reference numeral 61, the recording is performed for a one line. The timing T2 indicates that the next line recording data has been transferred to the thermal head 13, and that the recording for the next line (63) is ready. At this time, the judgment is made on the basis of the recording cycle (a period from the timing T1*a* to terminate the recording processing 61 to T2), and the black dot numbers contained in the line information to be recorded, or the value obtainable by subtracting the black dot numbers recorded in the recording processing 61 from the black dot numbers to be recorded in the recording processing 63. Here, it is assumed, for example, that the elapsed time from the timing T1*a* to the timing T2 is 30 ms or less and that the aforesaid difference in the black dot numbers is less than 512, any excessive conveyance of the ink sheet 14 is not executed after the termination of the recording processing 61.

On the other hand, in the recording operation which begins at the time T3, the ink sheet 14 is conveyed for a ½ n line portion [in the present embodiment, $(1/2)\times(1/7.7)\times 1/n$) mm] subsequent to the termination of the recording processing 65 as represented by a numeral 66, provided that the elapsed time is at least 30 ms or more from the termination point T2*a* of the recording processing 63 to the starting time T3 of the next recording operation 65, and that the black dot numbers in the one line recorded by the recording processing 65 satisfy the condition shown in FIG. 5C.

For the timing T4 to start the next recording processing 68, the period from the timing T3*a* for the termination of the last line recording to the T4 is short (less than 30 ms), and the conditions represented in FIG. 8C are not satisfied. Accordingly, the excessive conveyance of the ink sheet 14 is not executed after the recording processing 68. On the other hand, in the recording processing 70, even if the period from the timing T4*a* for the termination of the last line recording processing 68 to the starting timing T5 for recording processing 70 is short (less than 30 ms) and the black dot numbers to be recorded in the recording processing 70 are 1,800 (<1,843), for example, the ink sheet 14 is conveyed for a predetermined amount of $[(1/2)\times(1/7.7)\times(1/n)$ mm] subsequent to the recording processing 70 as designated by a numeral 71, provided that the black dot numbers recorded in this recording processing 70 is greater than the black dot numbers recorded in the last line recording process 68 by 512 or more.

Hence, according to the present embodiment, there is an effect that the ink sheet and recording medium can be separated more assuredly after the image recording by conveying the ink sheet for a predetermined length subsequent to the termination of the current line recording on the bais of the time interval after the termination of the last line recording as well as of the black dot numbers contained in the recorded line information or the difference between the black dot numbers in the last line and the black dot numbers in the current line.

Here, in the present embodiment, although the excessive conveyance of the ink sheet 14 subsequent to the termination of the current line recording is executed for a constant amount, the present invention is not limited thereto. This length of conveyance of the ink sheet 14 may be variable on the basis of the time interval after the termination of the last line recording, the black dot numbers contained in the recorded line information, the difference between the black dot numbers in the last line and the black dot numbers in the current line and others.

According to the present embodiment as described above, the ink sheet 14 and recording sheet 11 can be separated more assuredly in a thermal transfer printer by conveying the ink sheet 14 for a predetermined length subsequent to the termination of the current line recording on the basis of the time interval after the termination of the last line recording as well as of the black dot numbers contained in the recorded line information or the difference between the black dot numbers in the last line and the black dot numbers in the current line after the termination of the current line recording.

Also, according to the previous embodiment and the present embodiment, the ink about 14 can be separated from the recording sheet 11 reliably in a facsimile apparatus in response to the variations in the recording cycle caused by the changes in the recording modes such as standard, fine, and superfine. As a result, these embodiments are efficiently applicable to the facsimile apparatus and other recording apparatuses in which there is a possibility that the recording cycle is unevenly extended depending on the temporal intervals between the one-line image data or on its decoding processing time thereof.

Here, in the aforesaid two embodiments, the structure is arranged to control the ink sheet conveyance on the basis of the black dot numbers and the recording cycle, but it may be possible to control the energy which produces effects on the ink sheet on the basis of the black dot numbers.

Figure 10:
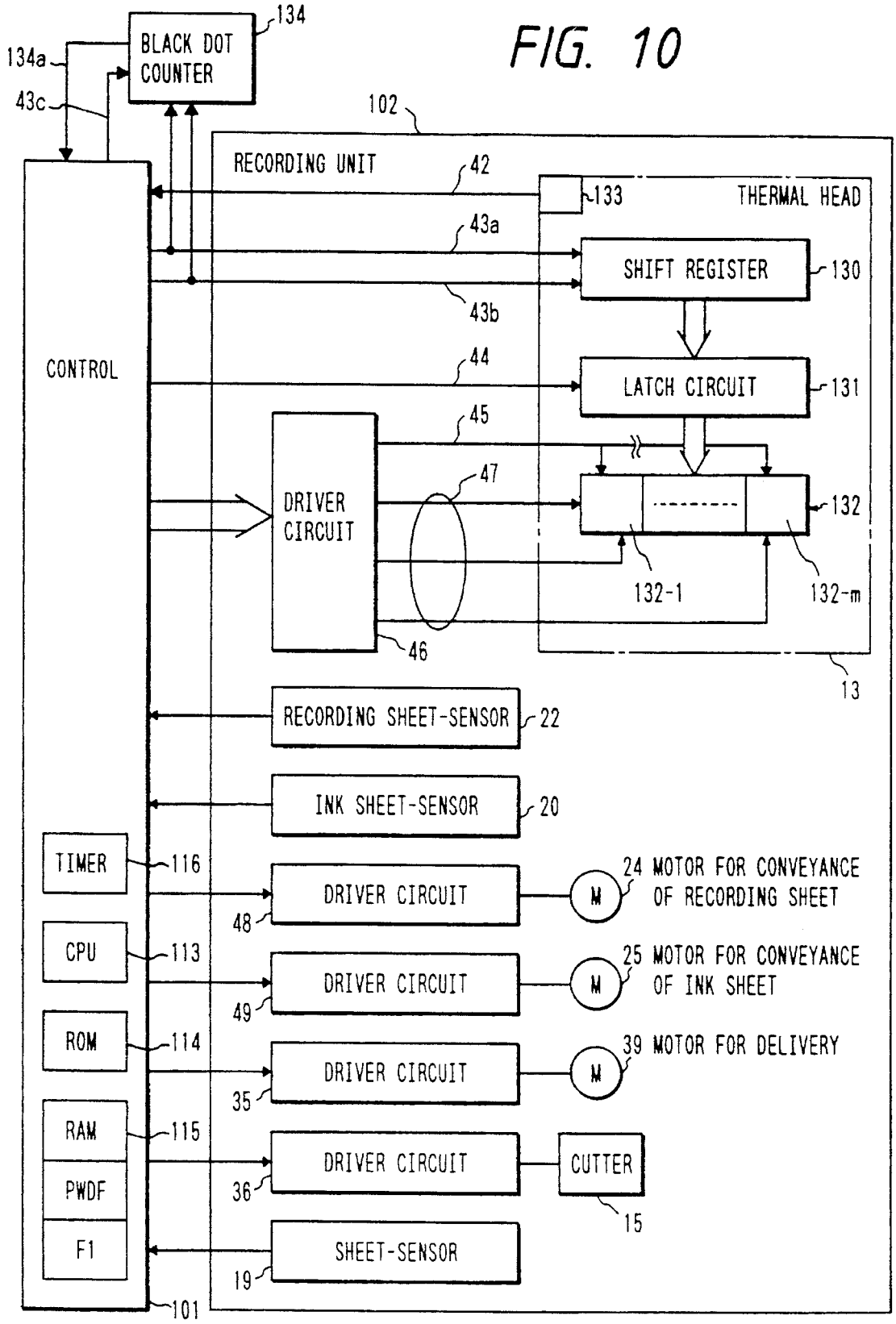
FIG. 10 is a block diagram showing the electrical connection between the control unit and recording unit in a facsimile apparatus according to a third embodiment of the present invention.

FIG. 10 is a block diagram showing the electrical connection between the control unit and recording unit in a facsimile apparatus according to the present embodiment. In this respect, the schematic structure and others of the facsimile apparatus in the present embodiment are the same as those appearing in FIG. 2 though FIG. 4. Therefore, the descriptions thereof will be omitted.

In FIG. 10, those having the same reference marks as in FIG. 1 are the same constituents, and what differs in the present embodiment from the one shown in FIG. 1 is that the flag F1 and power down flag PWDF, which will be described later, are provided in the RAM 115.

<Description of Recording Processing in the Present Embodiment (FIG. 2–FIG. 4 and FIG. 10–FIG. 12)>

Figure 11A:
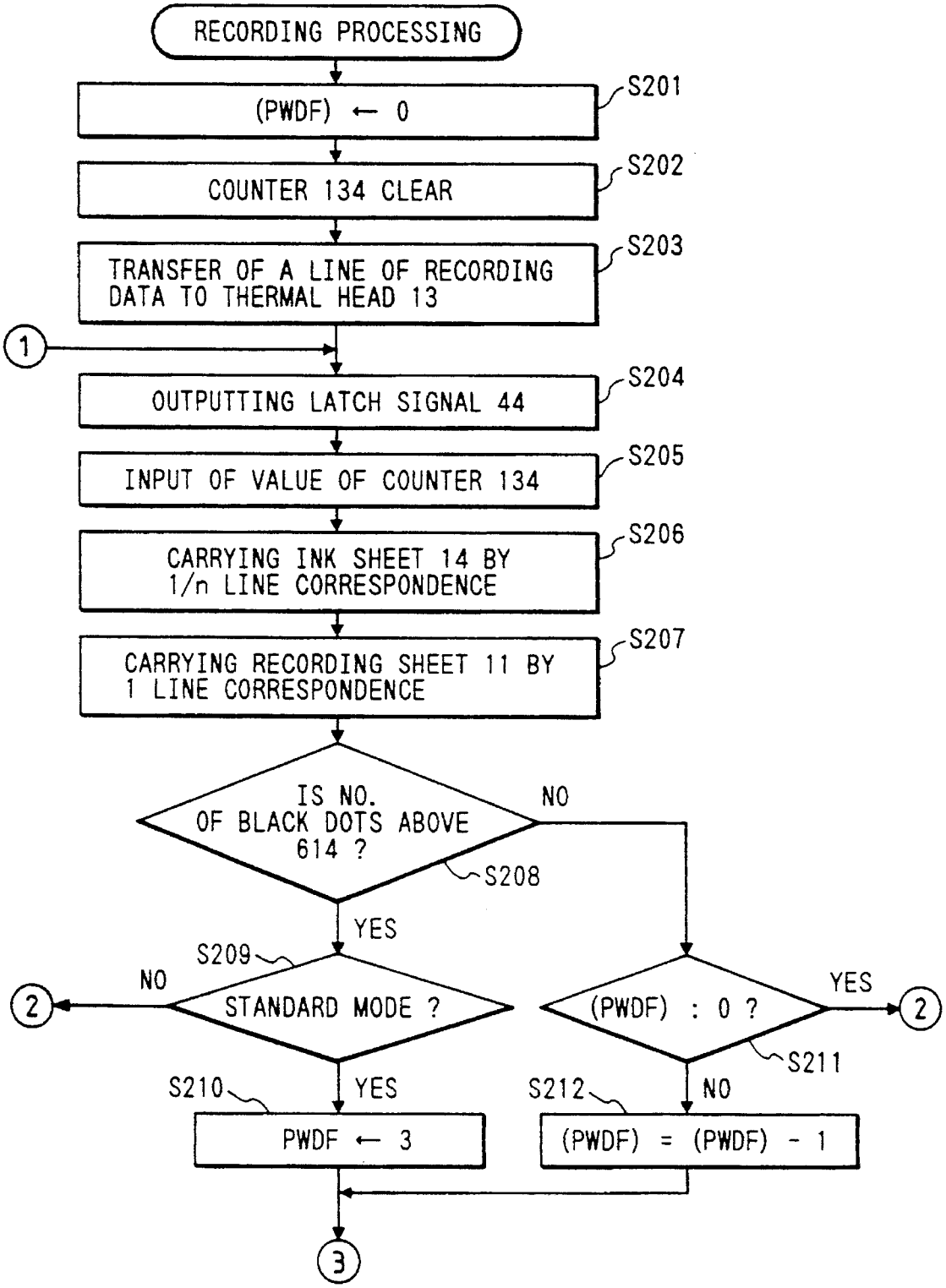
FIG. 11A, FIG. 11B and FIG. 11C are flowcharts showing the recording processing in the facsimile apparatus according to the third embodiment.
Figure 11B:
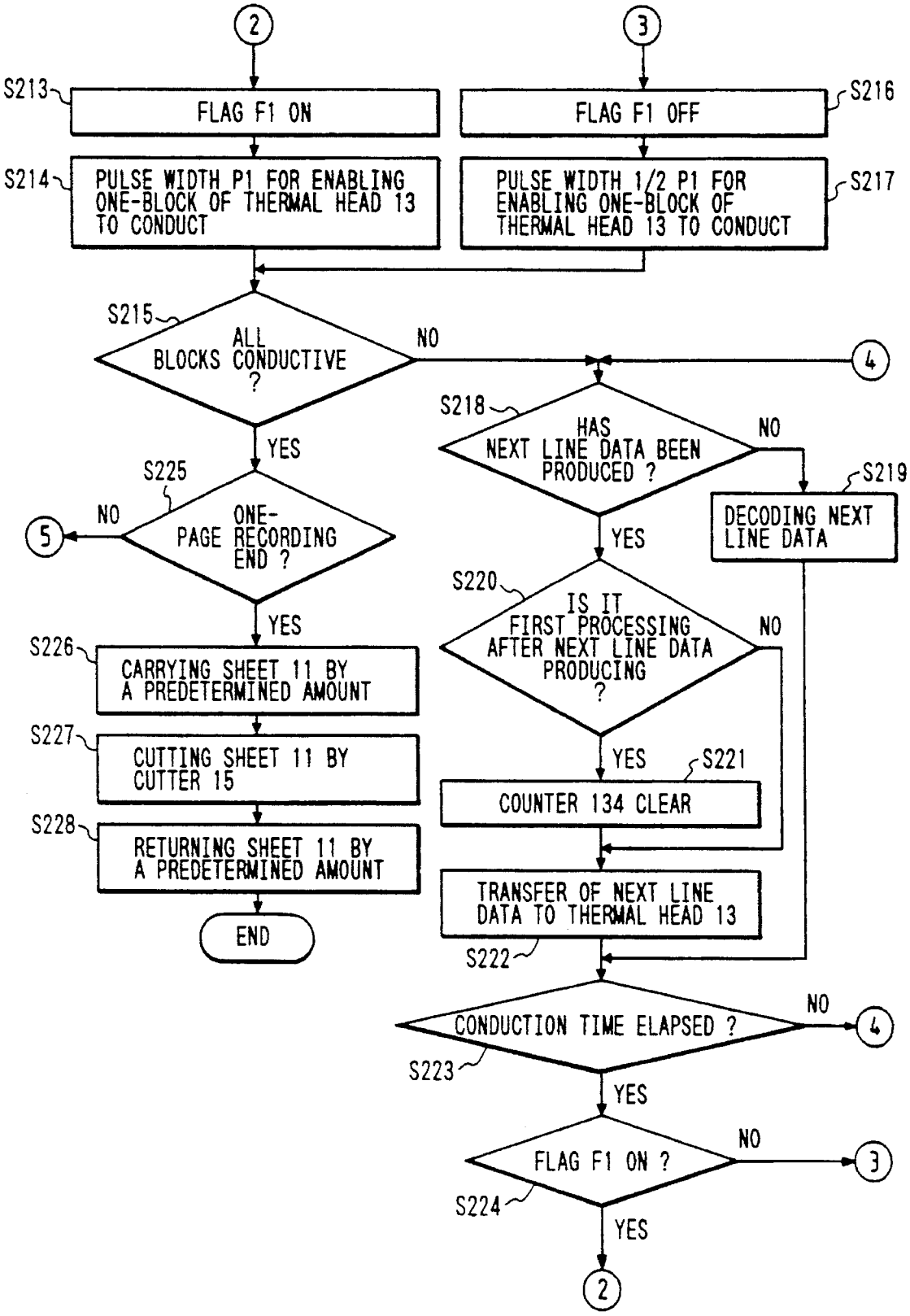
Figure 11C:
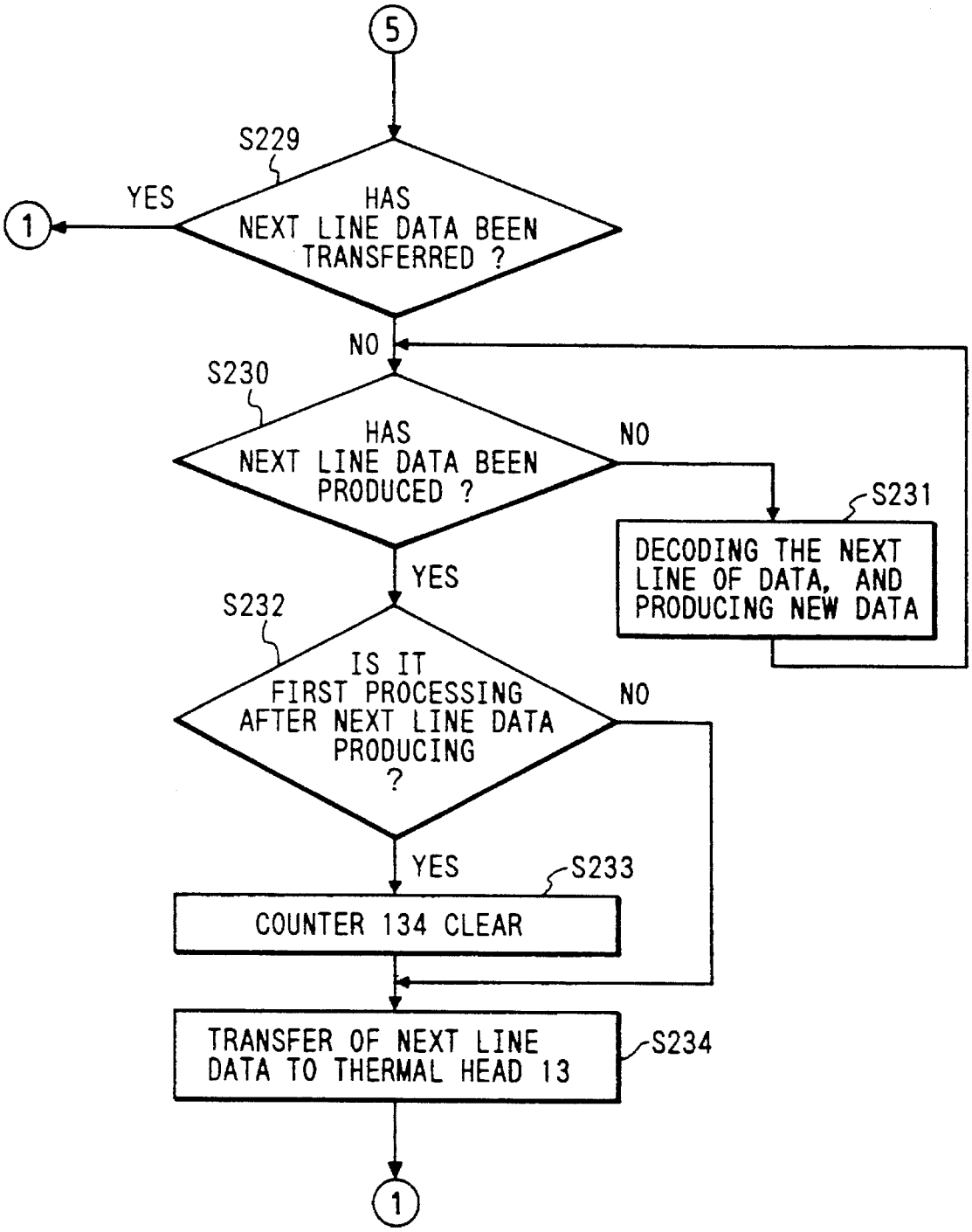

FIG. 11 is a flowchart showing the recording processing for a one-page portion in a facsimile apparatus according to the present embodiment. The control program for executing this processing is stored in the ROM 114 in the control unit 101.

This processing is started when the recording operation is ready to start with the one-line portion of the image data stored in the line memory 110 for an image to be recorded. Here, it is assumed that the control unit 101 has discriminated by the functions of the switch 103*a* and others that the multi-ink sheet 14 is installed.

At the step S201 at first, the power down flag (PWDF), which is provided in the RAM 115 to indicate that the power of the energy applied to the thermal head 13 is lowered (power down) for recording, is cleared to "0". Then, proceeding to the step S202, the process causes a clear pulse to be output in the signal line 43*c* to clear the black dot number counter 134. Subsequently, the process proceeds to the step S203 to output by serial signals the recording data of a one line portion to the shift register 130. When the transfer of the recording data of the one line portion has been completed, a latch signal 44 is output at the step S204 to store the recording data of the one line portion in the latch circuit 131. Then, the process proceeds to the step S205 to input the black dot numbers of the black dot number counter 134 through the signal line 134*a*. Hence, the black dot numbers in a one line to be recorded next are inputted.

At the step S206, the motor 25 for conveying ink sheet is driven to convey the ink sheet 14 for a 1/n line portion. Then, at the step S207, the motor 24 for conveying recording sheet 11 is driven to convey the recording sheet for a one line portion. In this respect, the length of this one line portion in the facsimile apparatus of the present embodiment is set at approximately (1/7.7) mm, and the conveying amounts of the recording sheet 11 and ink sheet 14 can be set respectively by changing the excitation pulse numbers of the motor 24 for conveying recording sheet and motor 25 for conveying ink sheet.

Now, advancing to the step S208, the process executes the examination of whether or not the black dot numbers which have been inputted at the step S205 in one line to be recorded next are 614 or more, and if the black dot numbers are 614 or more, the process proceeds to the step S209 to examine whether the next recording mode is a recording in the standard more or not. In the case of the standard mode, the process advances to the step S210 to set "3" to the PWDF in order to lower the energy applied to the thermal head 13 for recording the next line and subsequent three lines, and then advances to the step S216. This processing is needed because the conveying length of the recording sheet 11 in the subscanning direction becomes longer in the case of the standard mode, and the energy applied to the subsequent three lines including that line should be lowered at the time of recording in order to prevent the adhesion of the ink sheet 11 to the recording sheet 14 subsequent to recording a line contained more black dot numbers than the predetermined value. In this respect, if the recording is not in the standard mode at the step S209, i.e., if it is in the fine mode, the process proceeds to the step S213 to perform the recording without lowering the energy applied to the thermal head 13. This is possible because the conveying distances of the recording sheet 11 and ink sheet 14 in the subscanning direction during the period of recording each line are short in the fine mode, enabling the recording to be performed with a slight adhesion of the ink sheet 14 to the recording sheet 11 even without lowering the applied energy to the thermal head 13.

On the other hand, if the black dot numbers are less than 614 at the step S208, the process proceeds to the step S211 to examine whether the value of the PWDF is "0" or not. If the value is "0", the process advances to the step S213. If the value is not "0", it proceeds to the step S212 to decrement the PWDF value by 1, and then advances to the step S216.

At the step S213, the flag F1 of the RAM 115 (this flag F1 being a flag to indicate the destination for the process to return from the step S224) is turned on. Then, at the step S214, one of the blocks of the heat resistive unit 132 is energized to perform an image recording. At this juncture, the temperature of the thermal head 13 is detected on the basis of the signals from the temperature sensor 133 to change the pulse width of the strobe signal 47 applied to the thermal head 13 in response to the temperature thus detected. Here, the pulse width of the strobe signal 47 at that time is given as P1. In the meantime, at the step S216, the flag F1 is turned on and at the step S217, one of the blocks of the thermal head 213 is energized to perform the recording the same as the step S214. In this respect, the pulse width of the strobe signal 47 applied to the thermal head 13 at that time is given as P1/2. This is necessary because whereas each of the blocks of the thermal head 13 is energized only once for recording one line at the time of the fine mode recording, each of the blocks of the thermal head 13 is energized twice for recording one line at the time of the standard mode recording. In this case, since the thermal head 13 is divided into four blocks, a total of eight energizings is required to perform the one line recording.

Now, the process, proceeding to the step S215, to examine whether or not the one line recording is completed subsequent to the entire blocks of the thermal head 13 having been energized. Here, the judgment is made on the basis of whether a total of four energizings has been executed in the case of the fine mode and a total of eight energizings, in the case of the standard mode, or not, respectively. At the step S215, if the entire blocks of the thermal head 13 have not been energized as yet, the process proceeds to the step S218 to examine whether the recording data for the next line has been ready or not. If the data is ready, the process advances to the step S220 to examine whether the next step is the first one immediately after the formation of the next line data, i.e., subsequent to the next line data having been produced, and if it is the first step, then the process advances to the step S221 to clear the black dot number counter 134 by outputting a clear pulse to the counter 134 through the signal line 43*c*.

Then, the process proceeds to the step S222 to transfer the next line data to the shift register 130 of the thermal head 13, and at the step S223, to examine whether the energizing period (1,200 μs) has elapsed or not for the one block. If the energizing period has not elapsed yet, the process returns to the step S218 to execute the aforesaid processing. In this respect, if the next line data has been produced at the step S218, the process advances to the step S219 to decode the received signals for the next data line to convert them to the recording data. At the step S223, when the energizing period for the one line has elapsed, the process proceeds to the step S224 to examine whether or not the flag F1 is turned on, and if it is on, the process advances to the step S213 while if it is off, to the step S216.

Subsequent to the one line recording having been completed by energizing the entire blocks at the step S215, the process proceeds to the step S225 to examine whether a one-page image recording has been terminated or not. If the one-page image recording has been terminated, the process advances to the step S229 to examine whether or not the entire image data for the next line has been transferred to the shift register 130 of the thermal head 13. If the data has already been transferred, the process proceeds to S204 to execute the aforesaid processing. If, on the contrary, the next line data has not yet been prepared at the step S229, the process proceeds to the step S230 to examine whether or not the formation processing of the next line data has been terminated. If the formation has not been terminated as yet, the process advances to the step S231 for decoding the facsimile image signals for the next line to produce its recording data.

When the next line data has been produced in this way, the process proceeds to the steps S232 and S233 to clear the black dot number counter 134 as at the steps S220 and S221. Then, at the step S234, the process executes the transfer of the next line data to the shift register 130 of the thermal head 13, and returns to the step S204. Here, in the present embodiment, since the thermal head 13 is divided into four blocks, the time required for recording one line is approximately 5 ms (1,200 μs×4) in the fine mode and approximately 10 ms (1,200 μs×8) in the standard mode.

Next, when an image recording for the one-page portion has been terminated at the step S225, the process advances to the step S226 to convey the recording sheet 11 for a predetermined amount in the direction towards the exhaust sheet rollers 16*a* and 16*b*. Then, at the step S227, the cutters 15*a* and 15*b* are driven to engage to cut the recording sheet 11 into a unit of one page. Subsequently, at the step S228, the motor 24 for conveying recording sheet is driven to be reversely rotated to cause the recording sheet 11 to be retracted in a distance equivalent to the distance between the thermal head 13 and the cutter 15. The cutting processing for a page-unit recording sheet 11 is executed in this way.

Hence, according to the present embodiment, it is designed to improve the separation of the ink sheet 14 and recording sheet 11 when the ink sheet 14 and recording sheet 11 are conveyed in such a manner that if the black dot numbers in a one line to be recorded next are more than the predetermined numbers, the energy applied to the thermal head 13 at the time of the next line recording and subsequent line recordings is reduced in response to the recording mode at that time so as to minimize the force required for shearing ink from ink in the ink layers.

Figure 12:
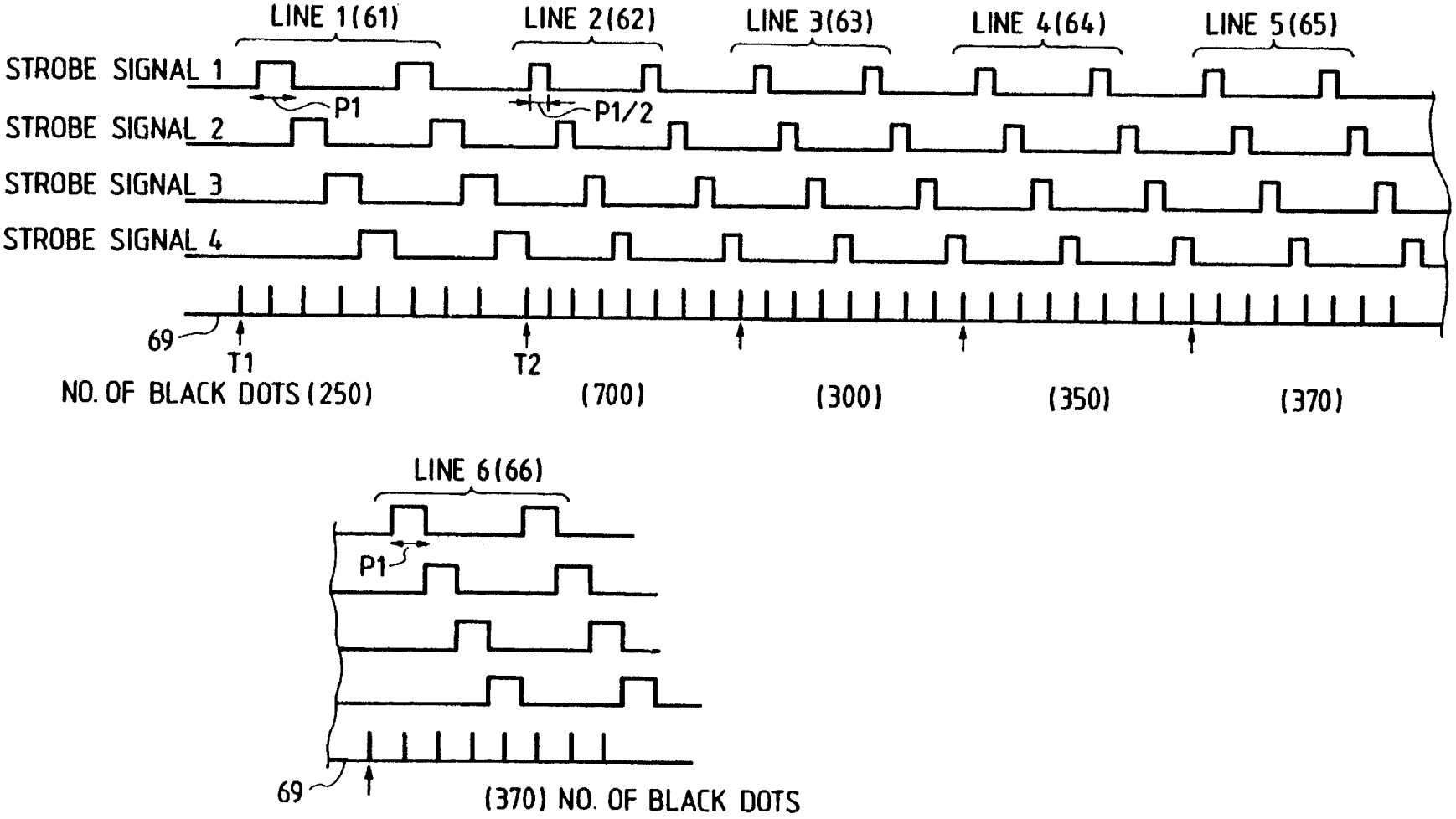
FIG. 12 is a timing chart showing the timing for energizing the thermal head as well as for conveying the ink sheet and recording sheet in the recording processing in the third embodiment.

FIG. 12 is a timing chart showing the timing to energize the thermal head 13 in the image recording processing of the present embodiment and the timing to convey the ink sheet 14 and recording sheet 11. Here, the heat resistive unit 132 of the thermal head 13 is divided into four blocks to be energized. In this respect, each of the strobe signals 1 to 4 corresponds to each of the block energizing signals of the heat resistive unit 132 of the thermal head 13. Here, the timing for the fine mode recording operation is represented, and the excitation phase of the corresponding motor is switched for only a (½) half step for each of the timing pulses for conveying the recording sheet 11 and ink sheet 14. Here, the recording sheet 11 is conveyed for ($1/7.7$) mm at four half steps and the ink sheet 14 is also conveyed for ($1/7.7$) mm at four half steps. Here, in this respect, the value n which represents the conveying length of the recording sheet 11 against that of the ink sheet 14 is "5".

In FIG. 12, a numeral 69 designates the timing for conveying the ink sheet 14 and recording sheet 11, also, the numbers shown at the bottom of each of the recording operation timings for the respective line represent the black dot numbers recorded in that line. The timing T1 indicates that the line 1 recording data has been transferred to the thermal head 13 completely, and that the recording in that line can be executed. At the timing T1, the excitation phase of each motor is switched to convey the ink sheet 14 and recording sheet 11 and each of the motors is driven for a half step. The motors are actuated before the recording operation is started because there is a temporal delay between the switching of the excitation phases of the motors and the conveyance of the recording sheet 11 and ink sheet 14. Subsequently, as indicated by a reference numeral 61, the recording is performed for a one line. The black dot numbers to be recorded by this recording operation 61 are 250 and are less than 614 dots. Consequently, the energy applied to the thermal head 13 for recording this line is not reduced, and the pulse width of the strobe signal 47 is given as P1.

Next, the recording operation for line 2 designated by a numeral 62 is executed. The timing T2 indicates that the line 2 recording data has been transferred to the thermal head 13, and that the recording for that line can be executed. At this juncture, the black dot numbers to be recorded in the line 2 are 700 dots and are more than 614. Therefore, it is necessary to reduce the energy applied to the thermal head 13. Because of this, the pulse width of the strobe signal 47 is reduced by ½ (P1/2). At the same time, when the three lines (line 3 to line 5) following the line 2 are recorded, the energy applied to the thermal head 13 is reduced (the pulse width of the strobe signal 47 being (P1/2) for each recording irrespective of the black dot numbers to be recorded in each of those lines. Then, the black dot numbers to be recorded in the line 66 are 370 dots and are less than 614 dots. Therefore, the recording is executed with the usual width of the strobe signal 47 as in the case of the line 1.

Here, in the aforesaid embodiment, although the recording is performed by energizing each block of the thermal head 13 once a time in the case of the fine mode recording, it may be possible to energize each of them plural times. Further, the motor 24 for conveying recording sheet is switched for four half steps in order to convey the ink sheet 14 or the recording sheet 11 for a (1/7.7) mm. However, the present invention is not limited thereto as a matter of course.

Also, in the aforesaid embodiment, the energy applied to the thermal head 13 is reduced at the time of recording the three lines subsequent to the line which includes 614 or more black dots. However, the line numbers can be defined arbitrarily. Further, in the aforesaid embodiment, although the applied energy is reduced only in the case of the standard mode, the energy may be reduced likewise in the case of the fine mode. Furthermore, while the reduction of the applied energy is effectuated by narrowing the width of the strobe pulse (in the example, the width being reduced by ½), the driving voltage to the thermal head 13 may be lowered instead, for example. Also, the standard value of the black dot numbers whereby to decide on the reduction of the energy applied to the thermal head 13 is defined as 614 dots. This value, however, can be set arbitrarily.

<Description of Recording Principle (FIG. 13)>

Figure 13:
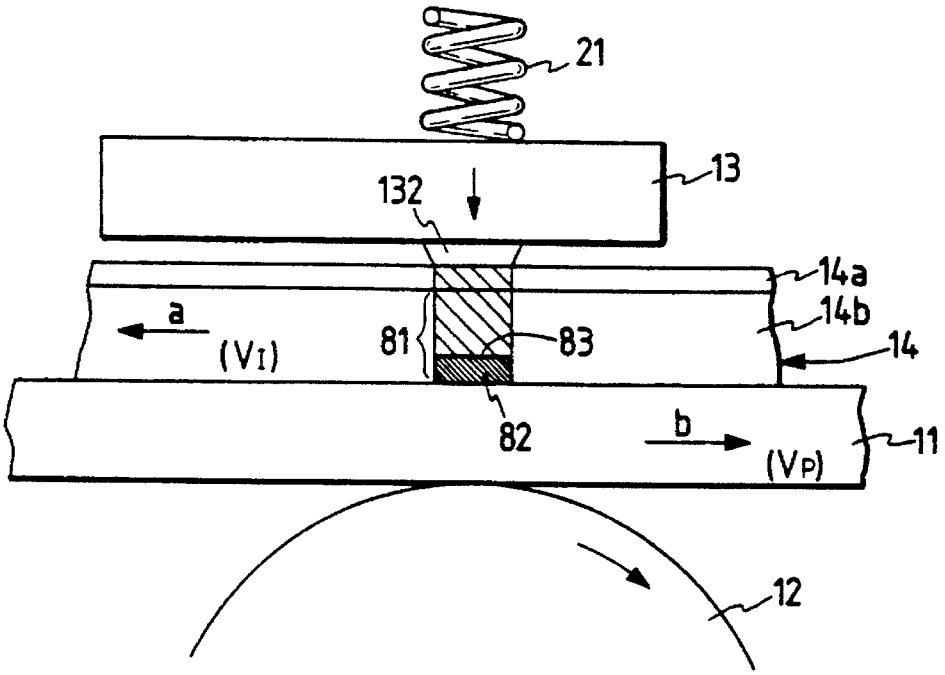
FIG. 13 is a view illustrating the principle of the multi-print at the time of recording in the first through third embodiments.

FIG. 13 is a view showing a state of image recording in the above-mentioned three embodiments wherein an image is recorded by conveying the recording sheet 11 and ink sheet 14 in the opposite direction.

As shown in FIG. 13, the recording sheet 11 and ink sheet 14 are pinched between the platen roller 12 and the thermal head 13. The thermal head 13 is pressurized by a spring 21 under a given pressure against the platen roller 12. Here, the recording sheet 11 is conveyed by the rotation of the platen roller 12 at a velocity Vp in the direction indicated by arrow b. Meanwhile, the ink sheet 14 is conveyed by the rotation of the motor 25 for conveying the ink sheet at a velocity $V_1$ in the direction indicated by an arrow a ($Vp=-nV_1$).

Now, when the heat resistive unit 132 of the thermal head 13 is heated by a current from the power source 105, the portion 91 of ink sheet 14 indicated by slashed lines is heated. Here, a reference numeral **14*a* designates the base film of in sheet 14; and 14*b*, the ink layer of the ink sheet 14. When the heat resistive unit 132 is energized, the ink in the heated ink layer 91 is fused, and a portion thereof indicated by reference numeral 92 is transferred to the recording sheet 11. This portion 92 to be transferred from the ink layer is almost equivalent to a 1/n of the portion of the ink layer indicated by the reference numeral 91. At the time of this transfer, it is necessary to generate a shearing force against ink at the boundary line 93 of the ink layer 14*b* so that only the portion indicated by the reference numeral 92 is transferred to the recording sheet 11. Here, in this respect, the reason why the ink sheet 14 and recording sheet 11 are conveyed in the directions opposite to each other is that by making the relative velocities of the ink sheet 14 and recording sheet 11 greater, the ink layer to be transferred is reliably separated from the ink sheet 14**.

<Description of Ink Sheet (FIG. 14)>

Figure 14:
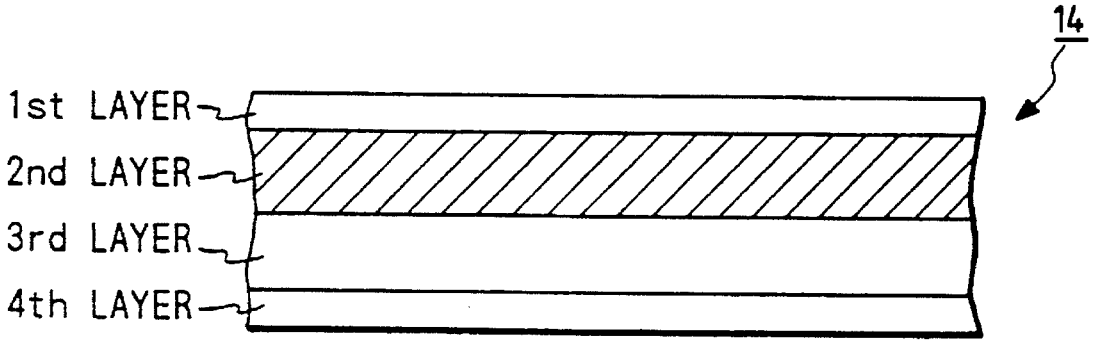
FIG. 14 is a view showing the sectional shape of the multi-ink sheet.

FIG. 14 is a cross-sectional view of the ink sheet used for a multiprint according to the present embodiment. Here, the ink sheet is formed with four layers.

First, a second layer is the base film which is a member to support ink sheet 14. In the case of multiprint, since the thermal energy is applied repeatedly to a same location, it is advantageous to use a high heat resistive aromatic polyamide film or a condenser sheet, but the conventional polyester film can also withsant the use. Although the thickness of the film should be as thin as possible for a better printing quality from the viewpoint of its role as a medium, the thickness of 3–8 μm is preferable from the viewpoint of the required strength.

A third layer is the ink layer containing an amount of ink which can be transferred to the recording paper (recording sheet) repeatedly for n times. The components thereof are resin such as EVA as adhesive, carbon black and nigrosine dye for coloring agent, and carnauba was, paraffin wax for binding agent. These elements are appropriately mixed as principle components to enable the layer to withstand a repeated application at a same location for n times. It is preferable to coat this layer in an amount of 4–8 $g/m^2$. However, such amount can be selected arbitrarily because its sensitivity and density differ depending on the coating amount.

A fourth layer is the top coating layer to prevent ink in the third layer from being transferred by pressure to the ink sheet at a location where no printing is executed. This layer is formed with a transparent wax or the like. Thus, the fourth layer which is transparent is the only portion to be transferred by pressure, and this prevents recording sheet from being stained. A first layer is the heat resistive coating layer to protect the second layer, which is the base film, from the heat of thermal head 13. This is suited for the multiprint for which heat energy for n lines is often applied to a same portion (when black information continues), but its application is arbitrarily selective. Also, this is effectively applicable to a base film with comparatively low heat resistivity such as polyester film.

In this respect, the composition of the ink sheet 14 is not limited to the present embodiment. For example, the ink sheet can also be formed with a base layer and a porous ink retaining layer containing the ink which is provided at one end of the base layer, or having a fine porous netting structure provided on the base film to contain ink. Also, as the materials for base film, for example, film or paper formed with polyamide, polyethylene, polyester, polyvinyl chloride, triacetilene cellulose, nylon can be used. Further, although the heat resistive coating is not necessarily required, its material may also be, for example, silicon resin, epoxy resin, fluorine resin, ethorocellulose, or the like.

In this respect, the heating method in a thermal transfer printer is not limited to the thermal head method using the aforesaid thermal head. The heating method using, for example, a current-carrying or laser transfer may also be employed.

Also, in the present embodiment, the description has been made of an example in which the thermal line head is used, but the application is not limited to this. A thermal transfer printer of the so-called serial type may also be employed. Further, although the description has been made of the multiprinting in the present embodiment, the application is not limited to this. An ordinary thermal transfer recording using a one-time ink sheet can also be employed as a matter of course. Furthermore, in the previous embodiment, although the description has been made of the case where the thermal transfer printer is applied to a facsimile apparatus, the application is not limited thereto and a thermal transfer recording apparatus according to the present invention can also be applied to a word processor, typewriter, copying machine, or the like.

Also, the recording medium is not limited to the recording sheet. If only a material is capable of accepting the transferred ink, cloth, plastic sheet or the like may be used as a recording medium. Also, the ink sheet is not limited to the rolled type as shown in the present embodiment. The ink sheet can be of a type such as stored in a housing which can be installed detachably in the main body of the recording apparatus, i.e., the so-called ink sheet cassette type which enables such a housing containing ink sheets to be mounted detachably as it is in the main body of the recording apparatus.

What is claimed is:

1. A thermal transfer recording apparatus for performing recording of an image on a recording medium by transferring ink contained in an ink sheet to said recording medium, comprising:

ink sheet conveyance means for conveying said ink sheet;

recording medium conveyance means for conveying said recording medium;

recording means for recording an image by a unit of line on said recording medium by activating said ink sheet, in accordance with a line recording information;

counting means for counting a number of black dots contained in a line recording information to be recorded by said recording means; and control means for controlling an energy which activates said ink sheet to be reduced at a time of recording said recording information when a counting value of said counting means is more than a predetermined number, wherein said control means reduces the energy which activates said ink sheet at a time of recording of an image of a line where the counting value of said counting means is more than a predetermined number and, in addition, an image of plural lines subsequent thereto.

2. A thermal transfer recording apparatus according to claim 1, wherein said control means reduces the energy which activates said ink sheet at a time of recording of an image of a line where the counting value of said counting means is more than a predetermined number and, in addition, an image of plural lines subsequent thereto, when a length in a direction orthogonal to a line direction of said image of a line is a predetermined length.

3. A thermal transfer recording apparatus according to claim 2, wherein said control means reduces the energy which activates said ink sheet at a time of recording of only an image of a line where the counting value of said counting means is more than a predetermined number, when the length in the direction orthogonal to the line direction of said image of a line is a predetermined length.

4. A thermal transfer recording apparatus according to one of claims 1–3, wherein said ink sheet and said recording medium are conveyed in opposing directions.

5. A thermal transfer recording apparatus according to claim 4, wherein said ink sheet transfers ink to a recording medium from a same location n times ($n \geqq 2$), and a length for conveying the ink sheet at a time of recording in a recording length L is L/n.

6. A thermal transfer recording apparatus according to one of claims 1–3, wherein said ink sheet transfers ink to a recording medium from a same location n times ($n \geqq 2$), and a length for conveying the ink sheet at a time of recording in a recording length L is L/n.

7. A facsimile apparatus using a thermal transfer recording apparatus for performing recording of an image on a recording medium by transferring ink contained in an ink sheet to said recording medium, comprising:

communication means for receiving line image data;

ink sheet conveyance means for conveying said ink sheet;

recording medium conveyance means for conveying said recording medium;

recording means for recording a line image on said recording medium by activating said ink sheet being conveyed by said ink sheet conveyance means in accordance with the line image data received by said communication means;

counting means for counting a number of black dots contained in line image data to be recorded by said recording means; and control means for controlling an energy which activates said ink sheet to be reduced when a counting value of said counting means is more than a predetermined number and said recording information is recorded by said recording means, wherein said control means reduces the energy which activates said ink sheet at a time of recording of an image of a line where the counting value of said counting means is more than a predetermined number and, in addition, an image of plural lines subsequent thereto.

8. A facsimile apparatus according to claim 7, further comprising selecting means for selecting one of a plurality of recording modes including a standard recording mode and a fine recording mode, and wherein said control means reduces the energy which activates said ink sheet at a time of recording of an image of a line where the counting value of said counting means is more than a predetermined number and, in addition, an image of plural lines subsequent thereto, in the standard recording mode.

9. A facsimile apparatus according to claim 8, wherein said control means reduces the energy which activates said ink sheet at a time of recording only an image of a line where the counting value of said counting means is more than a predetermined number in the fine recording mode.

10. A facsimile apparatus according to one of claims 7–9, wherein said ink sheet and said recording medium are conveyed in opposing directions.

11. A facsimile apparatus according to claim 10, wherein said ink sheet transfers ink to a recording medium from a same location n times ($n \geqq 2$), and a length for conveying the ink sheet at a time of recording in a recording length L is L/n.

12. A facsimile apparatus according to one of claims 7–9, wherein said ink sheet transfers ink to a recording medium from a same location n times ($n \geqq 2$), and a length for conveying the ink sheet at a time of recording in a recording length L is L/n.

* * * * *

UNITED STATES PATENT AND TRADEMARK OFFICE

CERTIFICATE OF CORRECTION

PATENT NO. : 5,530,470

DATED : June 25, 1996

INVENTOR(S) : TAKEHIRO YOSHIDA ET AL.

It is certified that error appears in the above-indentified patent and that said Letters Patent is hereby corrected as shown below:

TITLE PAGE:

AT [56] UNDER FOREIGN PATENT DOCUMENTS

"62-58917 1/1983 Japan" should read --62-58917 1/1987 Japan--

AT [57] IN THE ABSTRACT

Line 1, "performing the" should be deleted;
Line 4, "ink sheet" (first occurrence) should be deleted.

IN THE DRAWINGS:
AT SHEET 9, FIGURE 5D

"ERIOD" should read --PERIOD--.

AT SHEET 15, FIGURE 8D

"ERIOD" should read --PERIOD--.

COLUMN 1

Line 22, "the" should read --this--.

COLUMN 4

Line 3, "the second" should read --in the second--.

COLUMN 8

Line 61, "steps" should read --step--.

UNITED STATES PATENT AND TRADEMARK OFFICE

CERTIFICATE OF CORRECTION

PATENT NO. : 5,530,470

DATED : June 25, 1996

INVENTOR(S) : TAKEHIRO YOSHIDA ET AL.

It is certified that error appears in the above-indentified patent and that said Letters Patent is hereby corrected as shown below:

COLUMN 11

Line 38, "1/n)" should read --(1/n)--;
Line 56, "basis" should read --basis of--.

COLUMN 13

Line 34, "steps" should read --step--.

COLUMN 14

Line 45, "Thereafer," should read --Thereafter,--.

COLUMN 16

Line 46, "1/n)" should read --(1/n)--.

COLUMN 18

Line 54, "contained" should read --containing--.

COLUMN 22

Line 28, "withsant" should read --withstand--.

COLUMN 24

Line 5, "one" should read --any one--;
Line 12, "one" should read --any one--;

UNITED STATES PATENT AND TRADEMARK OFFICE

CERTIFICATE OF CORRECTION

PATENT NO. : 5,530,470

DATED : June 25, 1996

INVENTOR(S) : TAKEHIRO YOSHIDA ET AL.

It is certified that error appears in the above-indentified patent and that said Letters Patent is hereby corrected as shown below:

COLUMN 24 (cont'd)

Line 54, "one" should read --any one--;
Line 61, "one" should read --any one--.

Signed and Sealed this

Twenty-ninth Day of October 1996

*Attest:*

Bruce Lehman

BRUCE LEHMAN

*Attesting Officer*

*Commissioner of Patents and Trademarks*